US005332386A

United States Patent [19]

Hosome et al.

[11] Patent Number: 5,332,386

[45] Date of Patent: Jul. 26, 1994

[54] COMBUSTION CONTROL METHOD

[75] Inventors: Kazunari Hosome, Toyota; Syuzi Iida, Aichi; Katsutoshi Kimura, Toyota; Kazuya Tomathu, Toyota; Toshiji Tachibana, Toyota, all of Japan

[73] Assignee: Toyota Jidosha Kabushiki Kaisha, Toyota, Japan

[21] Appl. No.: 83,592

[22] Filed: Jun. 30, 1993

[30] Foreign Application Priority Data

Jul. 1, 1992 [JP] Japan ..... 4-174533
Oct. 14, 1992 [JP] Japan ..... 4-276333

[51] Int. Cl.[5] ..... F23N 5/08
[52] U.S. Cl. ..... 431/12; 431/79
[58] Field of Search ..... 431/12, 79

[56] References Cited

U.S. PATENT DOCUMENTS

| | | | |
|---|---|---|---|
| 3,902,841 | 9/1975 | Horn | 431/79 |
| 4,043,742 | 8/1977 | Egan et al. | 431/79 |
| 4,410,266 | 10/1983 | Seider | 356/45 |
| 4,477,245 | 10/1984 | Giachino et al. | 431/78 |
| 4,591,725 | 5/1986 | Bryant | 431/79 |
| 4,639,717 | 1/1987 | De Meirsman | 431/79 |
| 4,653,998 | 3/1987 | Sohma et al. | 431/12 |
| 4,934,926 | 6/1990 | Yamazaki et al. | 431/75 |
| 5,049,063 | 9/1991 | Kishida et al. | 431/78 |
| 5,222,887 | 6/1993 | Zabielski | 431/79 |

FOREIGN PATENT DOCUMENTS

| | | |
|---|---|---|
| 0046587A1 | 3/1982 | European Pat. Off. . |
| 3-294721 | 12/1991 | Japan . |

OTHER PUBLICATIONS

Patent Abstracts of Japan, vol. 16, No. 274 (M-1267) Jun. 19, 1992 & JP-A-04 068 212 (Toyota Motor Corp) Mar. 4, 1992.

Patent Abstracts of Japan, vol. 10, No. 70 (M-462) Mar. 19, 1986 & JP-A-60 213 725 (Yamatake Honeywell) Oct. 26, 1985.

Patent Abstracts of Japan, vol. 16, No. 135 (M-1230) Apr. 6, 1992 & JP-A-03 294 721 (Toyota Motor Corp).

Article entitled "Study of Optical Frequency Type Combustion Control Method", Toyota Technical Review, vol. 41, No. 2, Apr. 1992, pp. 42-50.

*Primary Examiner*—Carroll B. Dority
*Attorney, Agent, or Firm*—Finnegan, Henderson, Farabow, Garrett and Dunner

[57] ABSTRACT

Combustion facilities includes a combustion apparatus having a burner, a fuel control valve disposed along a fuel feeding pipe, a air control valve disposed along an air feeding pipe. An optical sensor detects radiated light originating in combustion flame of the burner, and converts it into a first electric signal. The first electric signal is a composite signal consisting essentially of an intensity signal element reflective of the intensity of the detected light and an oscillation signal element reflective of fluctuation of the turbulent combustion flame caused by the air feeding to the burner. A sensor amplifier, which is connected to the optical sensor, extracts both the oscillation signal element and an intensity factor representative of a real intensity of the radiated light originated in only the combustion flame, from the first electric signal, and generates a second electric signal by dividing the oscillation signal element by the intensity factor. A combustion controller, which is connected to the sensor amplifier, applies frequency analysis to the second signal, and calculates "Oscillation Power" based on the result of the frequency analysis. The oscillation power is closely related to the excess air ratio to be controlled. The combustion controller controls the air control valve based on the oscillation power, separated from the fuel control valve.

19 Claims, 22 Drawing Sheets

NO FILTRATION

FILTRATION

COMBUSTION CONTROL METHOD

BACKGROUND OF THE INVENTION

1. Field of the Invention

The present invention relates generally to a method for controlling combustion condition in a combustion apparatus such as a boiler or an industrial furnace.

2. Description of the Related Art

A boiler generates steam by heating up water with a burner, and supplies the steam to an equipment such as a heating device. In a system including the boiler and heating device, the steam pressure of the boiler will vary according to the amount of the steam which is consumed by the heating device. Therefore, the operating condition of the boiler should be controlled to maintain the steam pressure constant.

A conventional controller for a boiler includes a valve for controlling the flow of fuel, which is disposed along a pipe for feeding the fuel to the burner, and a valve for controlling the throughput of air, which is disposed along a pipe for feeding the air to the burner. To control the fuel flow to the burner, the controller controls an opening angle of the fuel control valve, via a control motor, so that the steam pressure detected by a pressure sensor approaches a predetermined pressure level. Further, the fuel control valve is connected to the air control valve, via a mechanism such as a link motion, to control the throughput of air in accordance with the fuel flow control. Accordingly, an actuation of the single control motor causes the fuel and air control valves to be simultaneously controlled.

However, it is impossible to achieve precise control of the throughput of air using the conventional controller. Because, the conventional controller is designed to just control the angle of the fuel control valve, and the angle control of the air control valve is therefore considered as a secondary control. In order to avoid air deficiency in any circumstances, the air control valve must be designed in advance to permit the air exceeding a theoretically proper amount to be supplied. Consequently, while the boiler is operating, the excess air supplied to the burner takes the boiler's heat away, and discharges the heat through a high temperature exhaust gas. In other words, the excess air feed reduces the thermal efficiency of the boiler. Such situation is not conducive to achieving high energy efficiency.

To solve the foregoing shortcomings, Japanese Unexamined Patent Publication 3-294721 discloses a combustion control system which includes a first control motor for controlling an angle of the fuel control valve and a second control motor for controlling an angle of the air control valve. In the control system, the feedback control of the air control valve is executed, independent of the fuel flow control, such that the throughput of air is most preferably controlled according to the fuel flow.

According to the control system, an optical sensor detects the radiated light originated in the combustion flame of the burner, and converts the detected light into a respective electric signal. FIG. 23A shows data relating the electric signal with respect to elapsed time elapsing, at every excess air ratio. The excess air ratio is defined as the ratio of the actual supplied air amount to the theoretical air amount which is required to completely burn a predetermined amount of fuel. The electric signal (i.e., combination signal including various frequencies) transmitted from the optical sensor is processed the well-known frequency analysis. The frequency analysis clarifies the relation between the frequencies (Hz) of each elemental signal of the combination signal and the signal strength (dBV) thereof. FIG. 21B shows the result of the frequency analysis, at every excess air ratio. The signal strength is integrated in the entire analyzed frequency region. This integrated value is referred to as an oscillation power.

In a certain case, the oscillation power, combustion rate and excess air ratio form a following correlation equation (1):

$$\lambda = c \times \exp(p \times f(x)) \quad (1)$$

in which "λ" is the excess air ratio, "c" is a constant value, "p" is the oscillation power, and "f(x)" is a function relating to the combustion rate.

According to the equation (1), the excess air ratio (λ) is a monotone increasing or decreasing function with respect to the oscillation power (p), and those elements show a one-to-one correlation. Therefore, the control of the excess air ratio utilizing the function (1) enables efficient combustion control for the combustion apparatus. TOYOTA Tecnnical Review Vol.41 No.2 April 1992 (English Version), Page 42–50 "Study of an Optical Frequency Type Combustion Control Method", written by the inventors of the present invention, describes in detail that the oscillation power calculated through the above-described manner on the basis of the radiated light originated in the burner flame may be utilized as an indicator for excess air ratio control in the combustion apparatus.

This article states the oscillation power as follows:

> "The oscillation power as the total sum of turbulence of the turbulent combustion flame was considered the indicator of the intensity of turbulent, and the experimental result suggested that the turbulence is closely related to the combustion state."

However, some types of the combustion apparatuses do not have a one-to-one correlation between the oscillation power and the excess air ratio. It is found that a chart of the correlation has a mountainous shape similar to a negative quadratic function, as shown in FIGS. 25 and 26. This fact suggests that the oscillation power reflects not only the fluctuation of the turbulent combustion flame but also the intensity of radiated light from the combustion flame (or an other factor corresponding to the intensity of radiated light). This point will be described in more detail, referring to an example.

The electric signal corresponding to the radiated light of the combustion flame of the burner, which is detected by an optical sensor, can be divided into a signal element indicative of the intensity of radiated flame light, and a signal element indicative of the oscillation reflecting the fluctuation of the turbulent combustion flame. FIG. 24 shows the relation between the excess air ratio and the signal element of light intensity. FIGS. 28A and 28B show the changes in the respective signal elements of light intensity and oscillation with respect to elapsed time. Furthermore, FIGS. 25, 26 and 27 show the correlations between the excess air ratio and the oscillation power, when the set frequencies for the frequency analysis are 20 Hz, 50 Hz and 300 Hz, respectively.

A comparison of FIGS. 24 and 25, shows there is strong correlation between the oscillation power and the signal element of light intensity, in the case that the set frequency is a relative low frequency such as 20 Hz, where the fluctuation of the turbulent combustion flame is less influenced by the change of the air throughput. The oscillation power is strongly influenced by the intensity of radiated light.

As shown in FIG. 23B, the higher the excess air ratio becomes, the greater the signal strength in the high frequency region becomes, due to the influence originated in the fluctuation of the turbulent combustion flame. Accordingly, when the set frequency for the frequency analysis is set to a rather high value (e.g., 300 Hz), the signal strength in the high frequency region increases as the excess air ratio increases. Consequently, the peak value of the oscillation power (i.e., the summit of the negative quadratic function) is shifted to the high excess air ratio side.

On the contrary, when the set frequency for the frequency analysis is set to generally small value (e.g., 20 Hz to 50 Hz), the peak value of the oscillation power is shifted to the low excess air ratio side as shown in FIGS. 25 and 26. It should be noticed that the peak value of the oscillation power in FIG. 25 (at 20 Hz of set frequency) is located in the lower excess air ratio side, comparing with that in FIG. 26 (at 50 Hz of set frequency which is slightly higher value than that in FIG. 25). The correlation between the excess air ratio and the signal element of light intensity, corresponding to the condition in FIG. 26, may be generally similar to that as shown in FIG. 24.

The reason for the occurrence of these phenomena originates in the proportional change of the amplitude of the oscillation signal element with respect to the change in the intensity of radiated light, that is understandable through the comparison between FIGS. 28A and 28B. As a normal furnace of the combustion apparatus is adiabatic to some degree, the internal temperature of the furnace is increased by the combustion of the fuel and air. The rise of the internal temperature increases the light intensity of infrared rays, which is detected by the optical sensor. As a result, the signal element of light intensity corresponding to the intensity of the detected infrared rays increases, and the amplitude of the oscillation signal element is increased proportionally with respect to the intensity of light.

The signal element which is strongly influenced by the intensity of light is particularly the element having a large amplitude (i.e., low frequency signal). Therefore, when the set frequency for the frequency analysis is set to a low value, the calculation of the oscillation power is greatly influenced by the signal element of light intensity rather than the oscillation signal element. Thus, the characteristic of the oscillation power is coincident with the characteristic of the signal element of light intensity as shown in FIG. 24.

According to the mountainous shaped charts as shown in FIGS. 25 and 26, even when the value of the oscillation power is specified, two solutions (i.e., two excess air ratios) corresponding to the specified oscillation power may exist in the limited range of excess air ratio to be utilized for combustion control. In this case, the oscillation power can not be an indicator of the excess air ratio control. The above-described equation (1) is just effective in a specific limited region of the excess air ratio. Accordingly, the application of the control method for the excess air ratio based on the oscillation power is just limited to some types of the combustion apparatuses.

To improve the practical use of the new method for excess air ratio control, it may be proposed to set the maximum measuring frequency for the frequency analysis to a high value. When the set frequency is 300 Hz as shown in FIG. 27, the oscillation power generally corresponds to the excess air ratio in the one-to-one manner. Then, the excess air ratio control based on the oscillation power can be achieved.

Even in the proposal, however, it has not been solved yet that the influence originated in the intensity of light causes the chart indicating the correlation between the excess air ratio and the oscillation power to become a mountainous shape. Accordingly, even when the frequency analysis in the wide frequency region including the very high frequency region (e.g., several hundreds Hertz through several thousands Hertz) is always carried out, the mountainous characteristic may be still maintained in response to the type of the combustion apparatus or the kind of fuel. Therefore, the conventional method for controlling the excess air ratio based on the oscillation power as an indicator has no wide use.

SUMMARY OF THE INVENTION

Accordingly, it is a primary objective of the present invention to provide a combustion control method in which the influence originated in the intensity of radiated light of the combustion flame is limited to or eliminated from the oscillation power to be calculated. According to the combustion control method, the excess air ratio will correspond to the oscillation power which is calculated based on the detected radiation light in a one-to-one manner. Consequently, a general application and reliability of the oscillation power, as an indicator for the excess air ratio control, can be increased.

To achieve the foregoing and other objects and in accordance with the purpose of the present invention, an improved method is provided for controlling combustion condition in combustion facilities.

The combustion facilities includes a combustion apparatus having a burner; a fuel feeding pipe connected to the burner and having a fuel control valve for controlling the feeding of fuel; an air feeding pipe connected to the burner and having an air control valve for controlling the feeding of air; a detection device for detecting radiated light originates in combustion flame of the burner; and a combustion controller for controlling an opening position (or opening angle) of the air control valve based on the detection data from the detection device.

The improved method comprises several steps as follows:

A) converting the radiated light detected by the detection device into a first electric signal, wherein the first electric signal includes an intensity signal element reflective of the intensity of the detected light and an oscillation signal element reflective of fluctuation of the turbulent combustion flame caused by the air feeding to the burner;

B) extracting the oscillation signal element from the first electric signal;

c) extracting an intensity factor representative of a real intensity of the radiated light originating in only the combustion flame, from the first electric signal;

D) generating a second electric signal by dividing the oscillation signal element by the intensity factor, so as to compensate the oscillation signal element which is influenced by the intensity of radiated light;

E) applying frequency analysis to the second electric signal;

F) calculating an oscillation power based on the result of the frequency analysis, wherein the oscillation power is related to the state of the combustion flame; and G) performing the feedback-control of the opening position of the air control valve, in such a manner that the calculated oscillation power approaches a predetermined optimum oscillation power.

In the case that the combustion apparatus is a boiler including a water-cooled internal wall, the intensity of radiated light which is detected by the detection device substantially will depend on only the intensity of light originating in the combustion flame itself. In this case, it is preferable that the intensity factor is the intensity signal element given by integrating the first electric signal.

In the case that the combustion apparatus is an industrial furnace including an internal wall and/or an accommodated material which can generate radiation heat when the internal temperature in the furnace becomes very high, the intensity of radiated light which is detected by the detection device will become the sum of those of the light originating in the combustion flame and the heat radiation originating in the internal wall and/or the accommodated material. In this case, it is preferable that the intensity factor is obtained on the basis of the oscillation signal element, instead of the intensity signal element. For example, the intensity factor can be formed by the two steps of: (1) applying rectification processing to the oscillation signal element; and (2) integrating the rectified signal. According to this manner, the intensity factor is free from the influence of such heat radiation.

BRIEF DESCRIPTION OF THE DRAWINGS

The features of the present invention that are believed to be novel are set forth with particularity in the appended claims. The invention, together with the objects and advantages thereof, may be best understood by reference to the following description of the presently preferred embodiments together with the accompanying drawings.

FIGS. 1 through 8 relate to a first embodiment of the present invention:

FIG. 1 is a schematic composite view of combustion facilities including a boiler, a sensor amplifier and a combustion controller;

FIG. 2 is an enlarged sectional view of the boiler body taken along line A—A of FIG. 1;

FIG. 3 is a block diagram illustrating the constitution of the sensor amplifier;

FIG. 4 is a functional diagram illustrating signal processing in the combustion controller;

FIG. 6 shows waveform charts of two types of electric signals processed by the sensor amplifier of FIG. 3. for comparison;

FIG. 7 is a graph illustrating the relationship between excess air ratio and oscillation power, when a set frequency for frequency analysis is 200 Hz; and FIG. 8 is a graph illustrating the relationship between excess air ratio and oscillation power, when a set frequency for frequency analysis is 300 Hz.

FIGS. 9 through 15 relate to a second embodiment of the present invention:

FIG. 9 is a schematic composite view of combustion facilities including a industrial furnace, a sensor amplifier and a combustion controller;

FIG. 10 is a block diagram illustrating the constitution of the sensor amplifier;

FIG. 12A is a waveform chart of electric signal DC/AC-converted in the case where no radiation influence exists, while

FIG. 13A is a graph illustrating the relationship between frequency and power spectrum in the case where no radiation influence exists, while

FIG. 14A is a graph illustrating the change of oscillation power as time elapses when the radiation influence is rectified in the manner of the first embodiment, while FIG. 15 is a graph illustrating the relation between excess air ratio and oscillation power in the second embodiment.

FIG. 15 through 21 relate to a third embodiment of the present invention:

FIG. 16 is a block diagram illustrating the constitution of a sensor amplifier including a high-pass filter;

FIG. 17A is a waveform chart of the second electric signal (No filtration) in the sensor amplifier, while

FIG. 18A is a graph illustrating the result of frequency analysis based on the second electric signal (No filtration) in the sensor amplifier, while

FIG. 19 is a graph illustrating the relationship between excess air ratio and oscillation power, when the oscillation power is more influenced by change in combustion state rather than by fluctuation of the turbulent combustion flame, due to the narrow range of measuring frequency on FFT processing (i.e. upper limit value thereof is too small);

FIG. 20 is a graph illustrating the relationship between excess air ratio and signal element of the intensity of light; and FIG. 21A is a graph illustrating the relationship between excess air ratio and oscillation power when the signal of FIG. 20 is FFT-processed with a FFT analyzer, while

FIGS. 23 through 28 are graphs illustrating various relationships without the benefit of the present invention:

FIG. 23A is a waveform chart illustrating change in the electric signal transmitted from an optical sensor as time elapses, while FIG. 23B is a graph illustrating the result of frequency analysis of the electric signal shown in FIG. 23A;

FIG. 24 is a graph illustrating the relationship between excess air ratio and signal strength corresponding to the intensity of radiated light from a combustion flame;

FIG. 25 is a graph illustrating the relationship between excess air ratio and oscillation power in the case where a set frequency for frequency analysis is 20 Hz;

FIG. 26 is a graph illustrating the relationship between excess air ratio and oscillation power in the case where a set frequency for frequency analysis is 50 Hz;

FIG. 27 is a graph illustrating the relationship between excess air ratio and oscillation power in the case where a set frequency for frequency analysis is 300 Hz.

DETAILED DESCRIPTION OF THE PREFERRED EMBODIMENTS

The first through fourth embodiments according to the present invention will now be described referring to accompanying drawings.

FIRST EMBODIMENT

The first embodiment according to the present invention, which is embodied in a boiler for supplying steam to a heating device disposed in a factory, will now be described referring to FIGS. 1 through 8.

Figure 1:
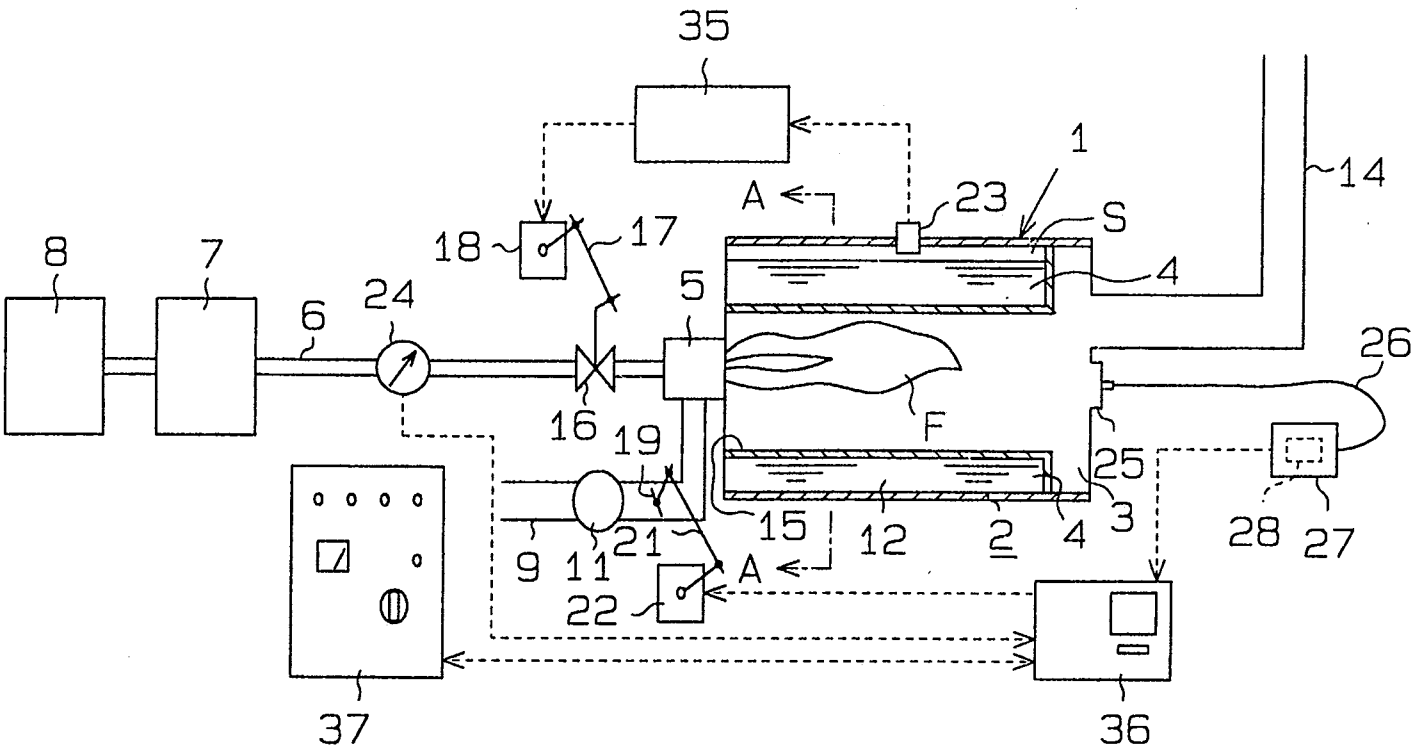
Figure 2:
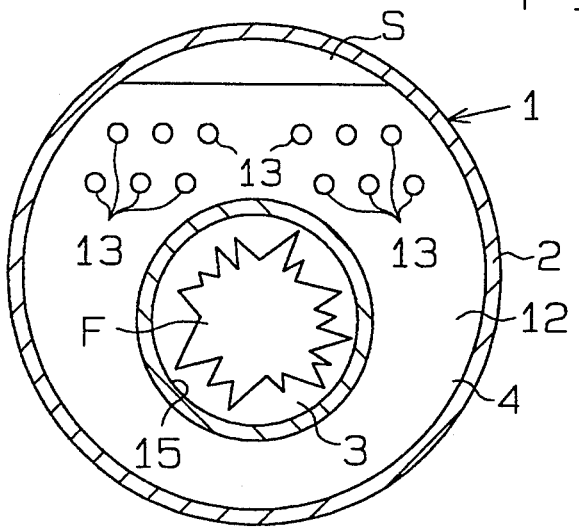

FIG. 1 is a schematic view showing entire combustion facilities including a boiler 1. FIG. 2 is a cross sectional view taken along line A-A in FIG. 1. The boiler 1 includes a body 2 which is generally cylindrical shaped and horizontally extant. The inner portion of the body 2 is divided into a combustion chamber 3 and a liquid chamber 4 which envelops the chamber 3. A burner 5 is disposed at the side wall of the body 2, and shoots a combustion flame (F) into the chamber 3. The burner 5 communicates with a fuel feed pump 7 and a fuel tank 8, via a fuel feeding pipe 6. Fuel stored in the tank 8 is supplied to the burner 5 through the fuel feeding pipe 6, in accordance with the work of the pump 7.

The burner 5 communicates with an air blasting fan 11, via an air feeding pipe 9. The air fan 11 supplies air to the burner 5. Therefore, the fuel and the air from the air fan 11 are supplied to the burner 5. The fuel and air are mixed and burnt by the burner 5, generating the combustion flame (F) The light originated in the combustion flame F includes two elements; one indicates the intensity of the illumination and the other indicates oscillation of the light.

The liquid chamber 4 is filled with liquid 12 (i.e., water), while a little space (S) is defined at the upper portion of the chamber 4. As shown in FIG. 2, a plurality of smoke tubes 13 are provided in the chamber 4. Exhaust gas generated in the combustion cheer 3 is discharged through the smoke tubes 13 to the outside from a funnel 14 which is projected from the chamber 3. The space (S) communicates with the heating device, via piping (not shown). Heat of the flame (F) of the burner 5 is transferred to the liquid 12 in the cheer 4, via a furnace wall 15 of the combustion chamber 3, as well as heat of the exhaust gas which is flowing through the tubes 13. The transmitted heat heats up the liquid 12 to generate steam. The steam is fed into the heating device through the piping.

As the liquid having rather large specific heat (i.e., water) is making contact with the furnace wall 15, temperature of the wall 15 will rise to the range of 200° C. to 300° C., but does not exceed that range. As steam pressure in the chamber 4 fluctuates according to the consumption of the steam by the heating device, flow of the fuel is regulated to maintain the steam pressure constant.

A fuel control valve 16 and flow meter 24 are disposed midway along the fuel feeding pipe 6. The flow meter 24 measures the flow of fuel flowing through the pipe 6. The control valve 16 controls the flow of fuel supplied to the burner 5. The control valve 16 is connected with a control motor 18 which operates the valve 16 for controlling an opening angle thereof, via a link motion 17. An air control valve 19 is disposed midway along the air feeding pipe 9, and controls the throughput of air supplied to the burner 5. The air valve 19 is connected with a control motor 22 which operates the valve 19 for controlling an opening angle thereof, via a link motion 21. The control motors 18 and 22 have drive shafts which can be rotated in accordance with input signals, respectively.

A pressure gauge 23 is disposed at the upper portion of the body 2, for the purpose of monitoring operational condition of the boiler 1. The pressure gauge 23 detects the steam pressure generated by heating the liquid 12. Further, an observation hole 25 is formed at the boiler body 2, in alignment with the burner 5. The observation hole 25 is connected to a sensor amplifier 27, via an optical fiber 26.

Figure 3:
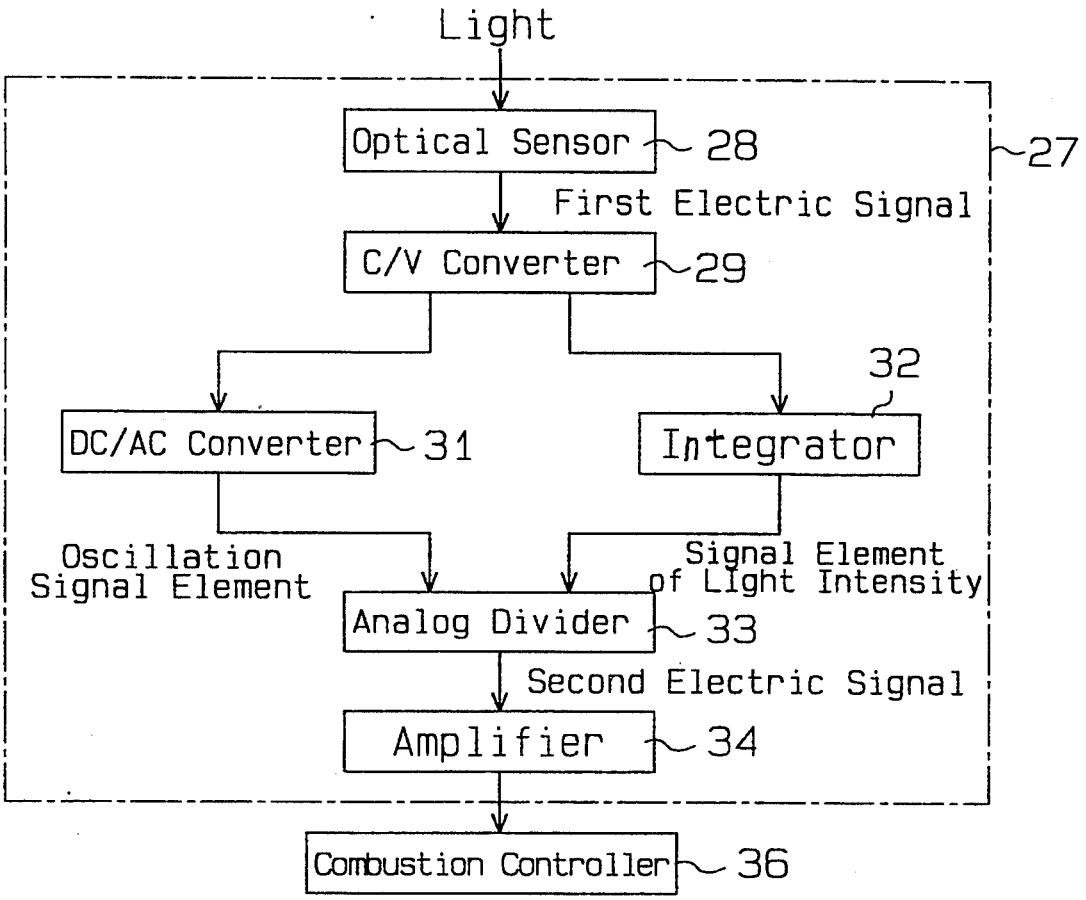

As shown in FIG. 3, the sensor amplifier 27 includes an optical sensor 28 constructed with an infrared detecting element such as a germanium photo diode or photo transistor. The optical sensor 28 receives the flame light through the hole 25, and converts it to a first electric signal. In other words, the sensor 28 generates electro motive current which has magnitude proportional to the intensity of the illuminates of the flame (F). The sensor amplifier 27 further includes a current-voltage converter 29, a DC/AC converter 31, an integrator 32, an analog divider 33 and an amplifier 34. The first electric signal from the optical sensor 28 is processed in various ways by means of the devices 29 through 34.

As shown in FIG. 1, the pressure gauge 23 is connected to an input terminal of a pressure regulator 35. An output terminal of the regulator 35 is connected with the control motor 18. The regulator 35 transmits a drive signal to the motor 18 according to a steam pressure signal from the pressure gauge 23 to control an angle of the fuel control valve 16. Fuel supply to the burner 5 is controlled by the control of the valve angle to maintain the steam pressure in the chamber 4 at the predetermined level. As a result, the steam is steadily supplied to the heating device.

The flow meter 24 and sensor amplifier 27 are connected to respective input terminals of a combustion controller 36. Allowable input voltages of the controller 36 employed in this embodiment are set at ±2.5V. An output terminal of the controller 36 is connected to the control motor 22. The combustion controller 36 performs an operational processing based on an analog signal transmitted from the amplifier 27 and a signal indicative of the fuel flow transmitted from the flow meter 24. The controller 36 drives the control motor 22 according to the result of the operational processing so as to control an angle of the air control valve 19.

The controller 36 is to and mutually communicates with a control panel 37 through data. For example, when some abnormal condition occurs in the boiler 1, the controller 36 transmits a signal to the control panel 37 in order to forcibly suspend the operation of the boiler 1.

The signal processing operation of the sensor amplifier 27 will now be described referring to FIG. 3.

The optical sensor 28 receives the light of the flame of the burner 5, via the observation hole 25 and the optical fiber 26, and converts it to a first electric signal (current). The first electric signal can be divided into the signal elements indicating the oscillation and intensity of light. Amplitude of the oscillation signal element is generally proportional to the intensity of the combustion flame light. In other words, as the intensity of the light decreases, the amplitude of the oscillation apparently decreases. Likewise, as the intensity of the light increases, the amplitude of the oscillation apparently increases.

Figure 5A:
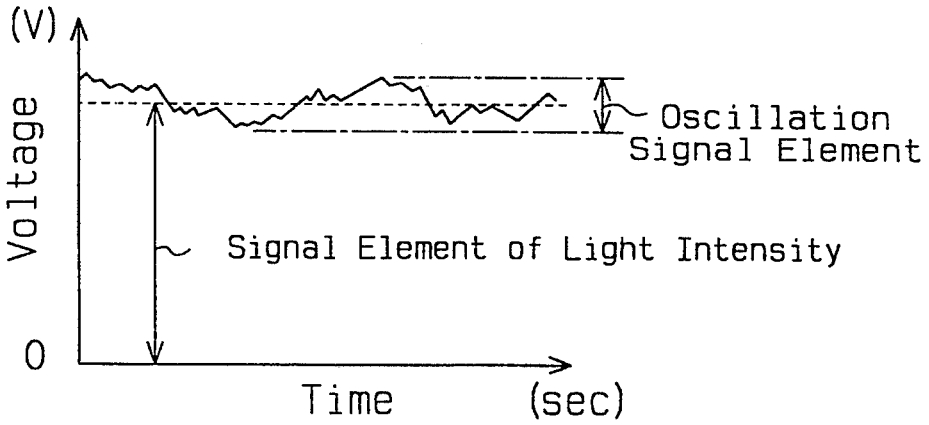
FIGS. 5A, 5B, and 5C are waveform charts of various electric signals to be processed by the sensor amplifier of FIG. 3.
Figure 5B:
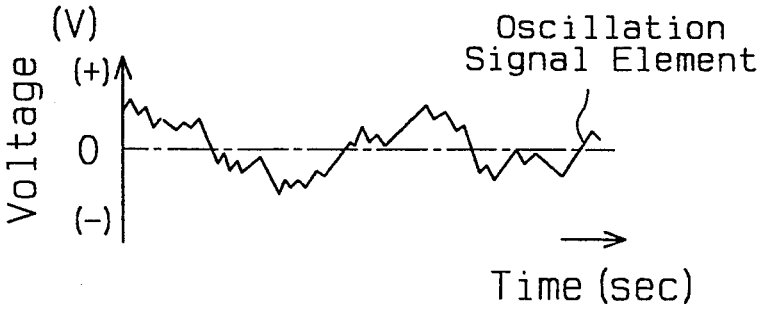
Figure 5C:
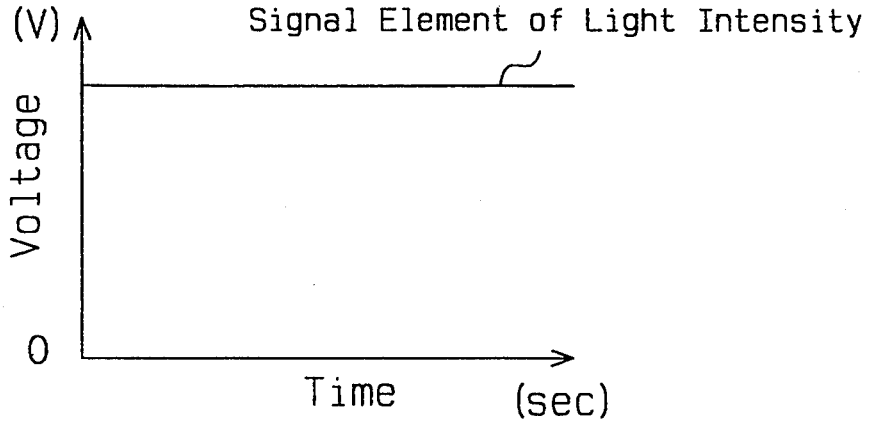

The current-voltage converter 29 in the sensor amplifier 27 converts the first electric signal to a respective voltage signal shown in FIG. 5A. This voltage signal oscillates with time and a predetermined direct current voltage is an oscillation center. In the waveform of the voltage signal, the average value of the DC voltages indicates the intensity of light, and the amplitudes of the oscillation indicate fluctuation of the turbulent combustion flame (F).

The DC/AC converter 31 eliminates the signal element of light intensity from the signal shown in FIG. 5A, and converts the remaining signal element into a respective alternating current voltage signal. The oscillation signal element of the first electric signal can be extracted through the above-described method.

The integrator 32 integrates the waveform of the signal shown in FIG. 5A. A damping time constant of the integrator 32 can be arbitrarily set. Therefore, it can be adjusted as required. Through this integration, the oscillation element of the waveform is graduated (or leveled) so as to obtain the average value of the intensity of light. Thus, the signal element of light intensity of the first electric signal can be extracted.

The reason why the integrator 32 processes signals from the current-voltage converter 29 will now be described. Assume the case which the analog divider 33 divides a signal (i.e., oscillation element) transmitted from the DC/AC converter 31 by a signal transmitted from the current-voltage converter 29, instead of the signal transmitted from the integrator 32. Then, following drawbacks or problems may be generated. The oscillation signal element transmitted from the converter 31 as well as the signal from the converter 29 should be altered as time elapses. When the oscillation signal element is divided by the signal from the converter 29, this division may not generate any problems in the low frequency region. However, the division performed in the high frequency region distorts the output waveform of this calculation, such that the result of this division may include a significant error. Therefore, the integrator 32 performs the integration operation, in consideration of the accurate operation performed by the analog divider 33.

The divider 33 divides the oscillation signal element by the signal element of light intensity. Since the amplitude of the oscillation element in the first electric signal is proportional to the light intensity of the combustion flame, the result of division performed by the divider 33 is significantly accurate in the whole region of frequency. The divider 33 generates a second electric signal in which the influence of light intensity is rectified. The second electric signal is formed by the only element originating from the fluctuation of the turbulent combustion flame (F).

Figure 6A:
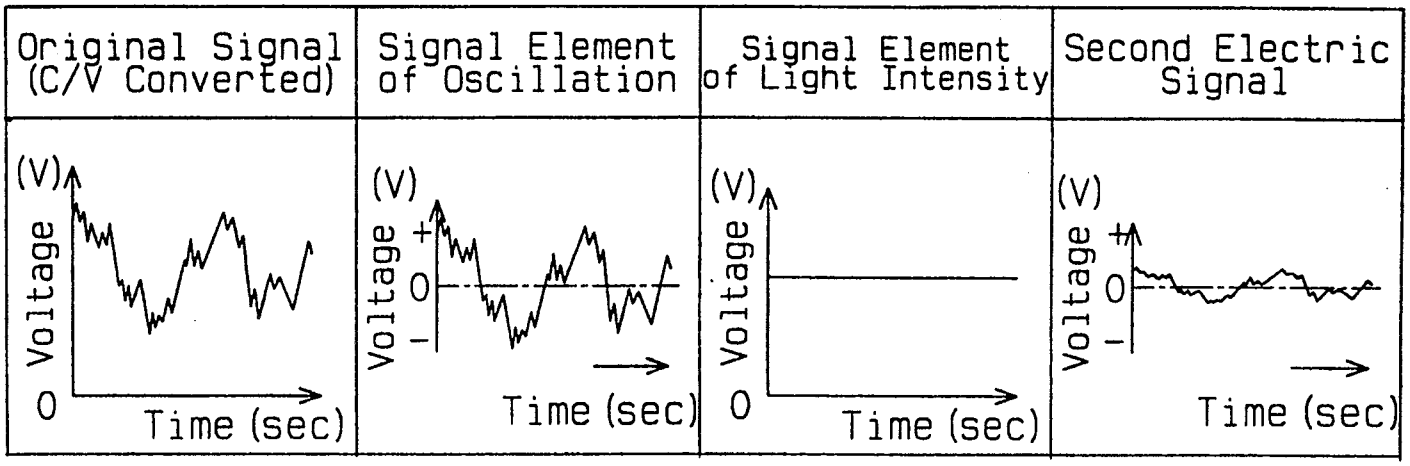
Figure 6B:
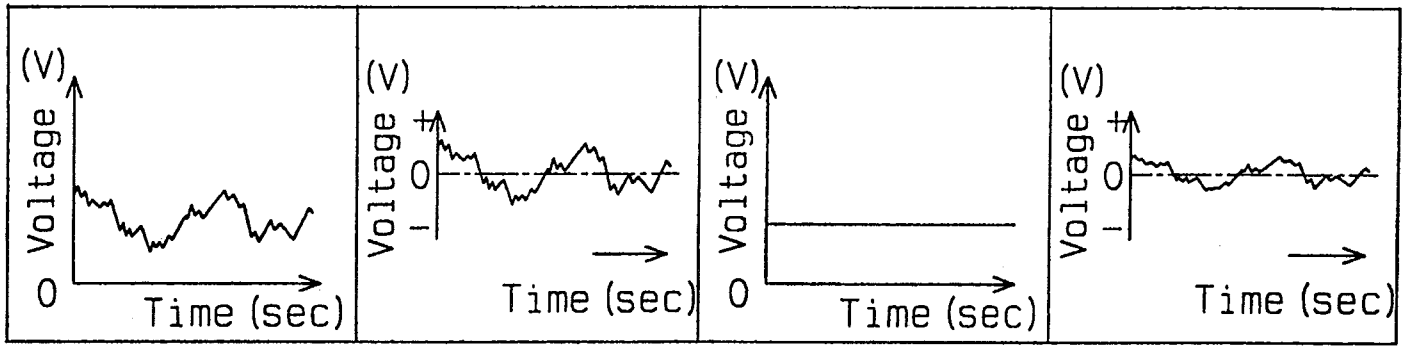

As shown in FIG. 6, after the conversion of current to voltage is carried out, two signals (a) and (b) of which waveform differ from each other, may be obtained. In such case, even when the signal elements of light intensity of two signals differ from each other, if the degree of the fluctuation of the turbulent combustion flame is constant in each case, the waveform of the second electric signal based on the signal (a) is generally similar to that based on the signal (b). It will be further described in detail. In the case (a) where an original signal has relatively large amplitude, the average voltage of the signal element of light intensity is high. Therefore, the amplitude of the second electric signal obtained through the division is small. On the other hand, in the case (b) where an original signal has relatively small amplitude, the average voltage of the signal element of light intensity is low. Therefore, the amplitude of the second electric signal obtained in the case (b) is substantially equal to that of the second signal obtained in the case (a). Even when the amplitudes of the original signals are different from each other due to the influence of the intensity of light, the influence of light intensity can be quantitatively rectified by dividing by the signal element of light intensity.

The second electric signal output from the analog divider 33 includes low frequency elements which have certain amplitudes and high frequency elements which have smaller amplitudes than those of the low frequency elements. The amplifier 34 in the sensor amplifier 27 amplifies the compensated second electric signal to a predetermined level, and transmits it to the combustion controller 36.

The operation of the combustion controller 36 will now be described referring to FIG. 4. The controller 36 calculates an oscillation power of the combustion flame (F) based on the analog signal transmitted from the amplifier 27 and a target oscillation power which corresponds to the most preferable excess air ratio in accordance with the fuel flow at the moment. The controller 36 adjusts the opening angle of the air control valve 19 to converge the real oscillation power with the target oscillation power.

It will be further described in detail. An A/D converter 38 disposed in the controller 36 converts an analog signal transmitted from the sensor amplifier 27 into a respective digital signal. The converter 38 employed in this embodiment has a 12-bit discrimination or resolution. After the A/D conversion is performed, a digital signal processor 39 (hereinafter referring to as DSP 39) disposed in the controller 36 performs fast Fourier transform (FFT) on the digital signal, which is executed in a FFT processing unit 41. In the controller 36 employed in this embodiment, the upper limit of the measuring frequency range for FFT processing can be set as high as 500 Hz.

Figures 23A, 23B:
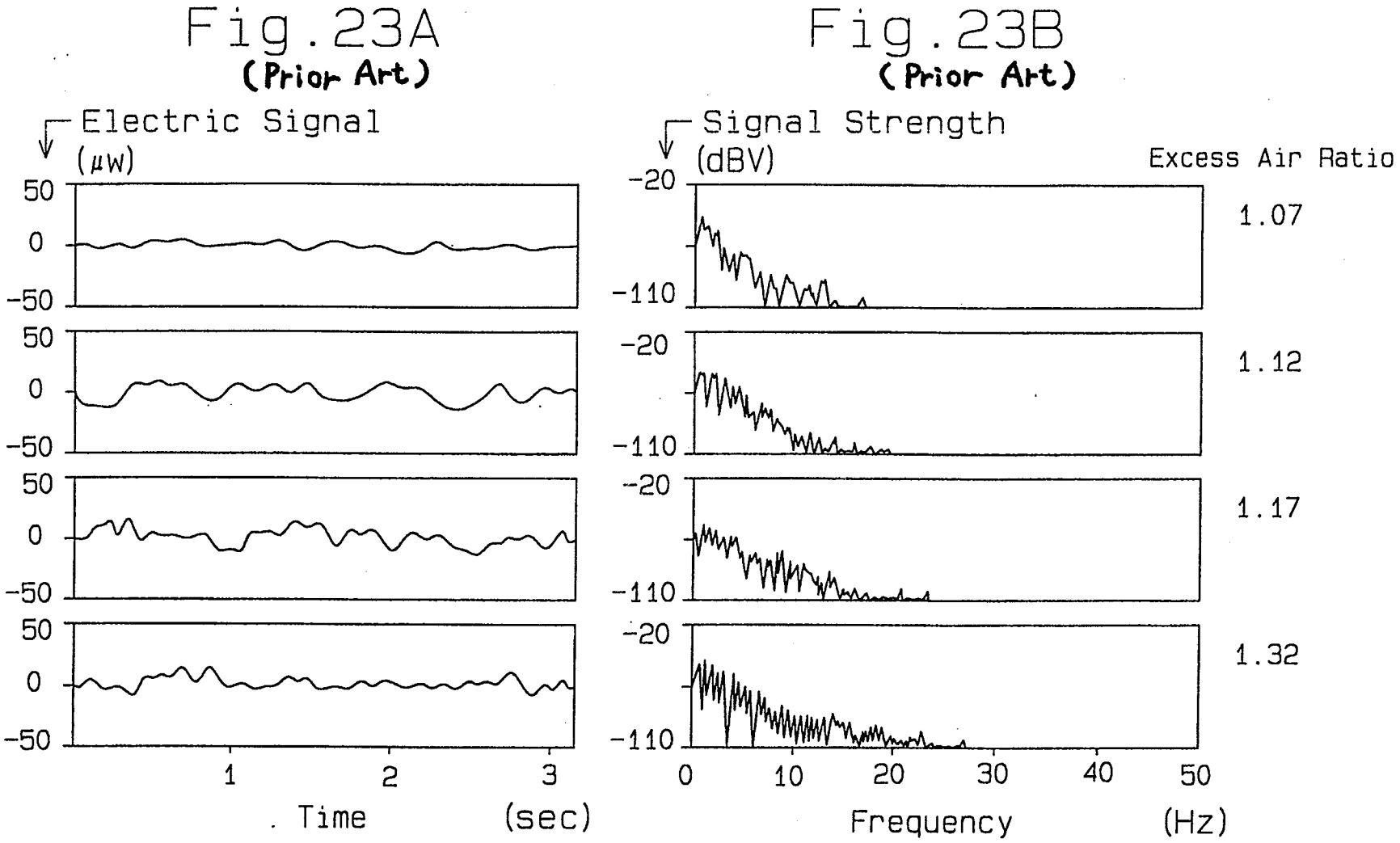
Fig. 23B (Prior Art)
Fig. 23A (Prior Art)
Figure 24:
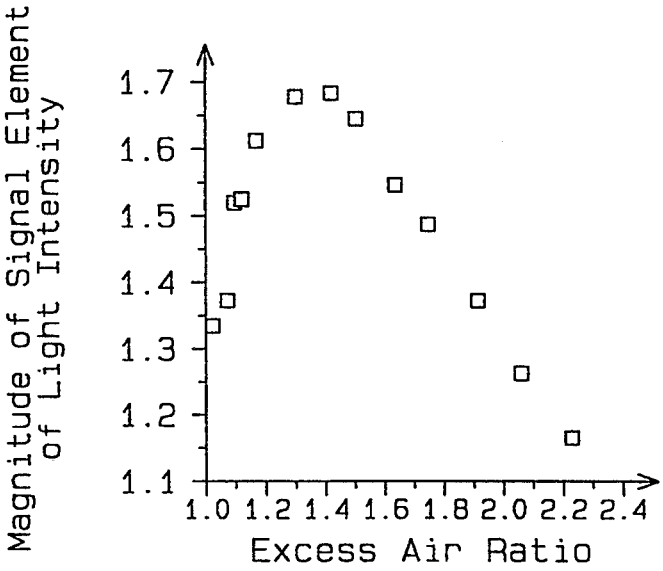
Fig. 24 (Prior Art)
Figure 25:
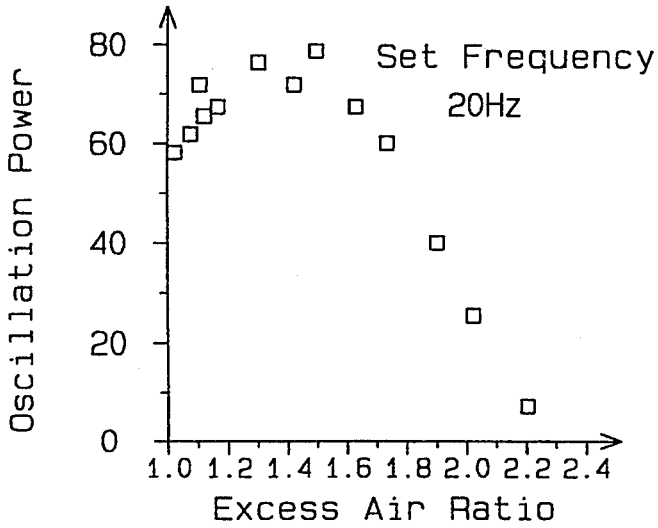
Fig. 25 (Prior Art)
Figure 26:
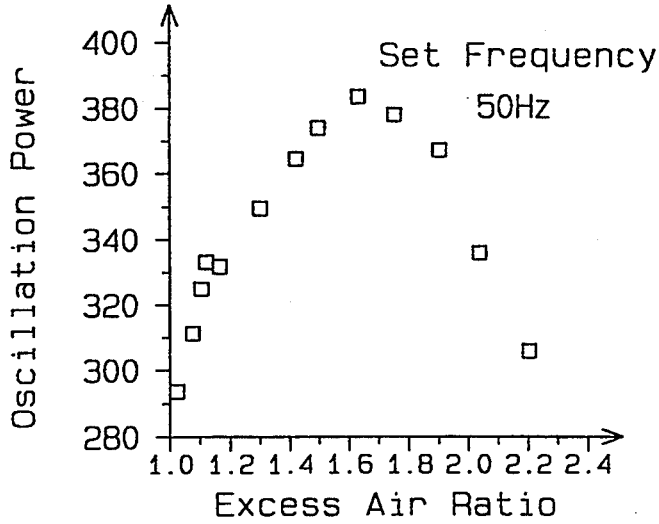
Fig. 26 (Prior Art)
Figure 27:
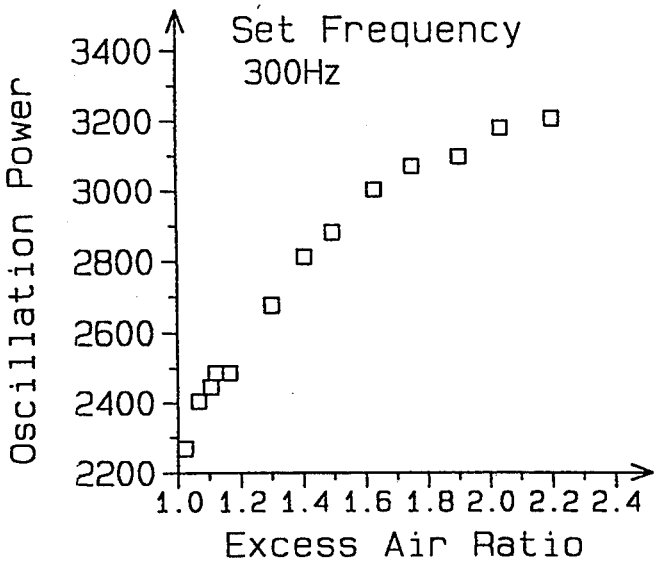
Fig. 27 (Prior Art)
Figure 28A:
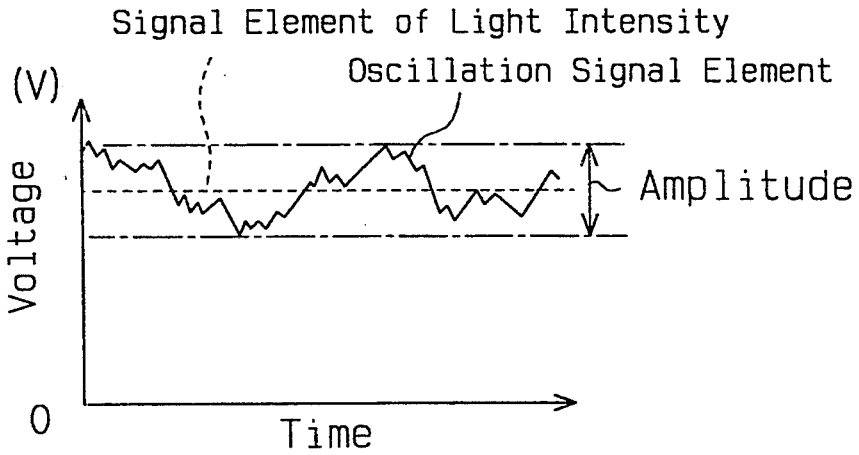
Fig. 28A (Prior Art)
FIGS. 28A and 28B are waveform charts illustrating changes of the respective elements of light intensity and oscillation of the electric signal corresponding to radiated light from combustion flame, as time elapses.
Figure 28B:
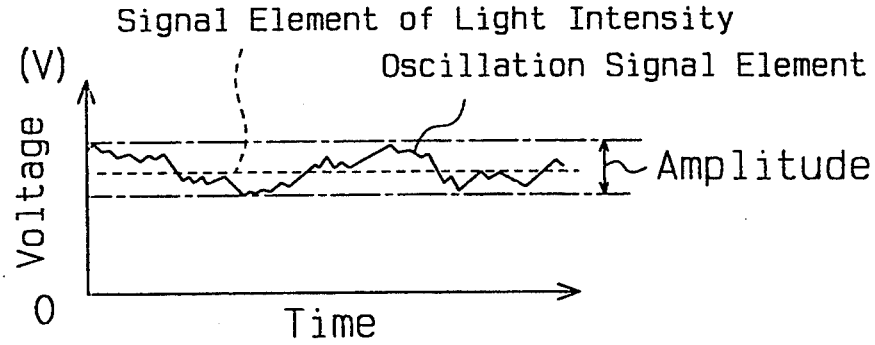
Fig. 28B (Prior Art)

The FFT processing is for calculating the intensity of signal elements which correspond to various frequencies in the digital signals, respectively. The FFT processing provides the power spectrum of the various frequencies, as shown in FIG. 23B. Since the area defined by a waveform of the spectrum is closely related to combustion condition, the condition can be estimated by measuring the respective area. Therefore, the FFT processing unit 41 integrates the waveform of the spectrum over the whole frequency region, so as to calculate the area of the waveform (i.e., oscillation power).

Figure 7:
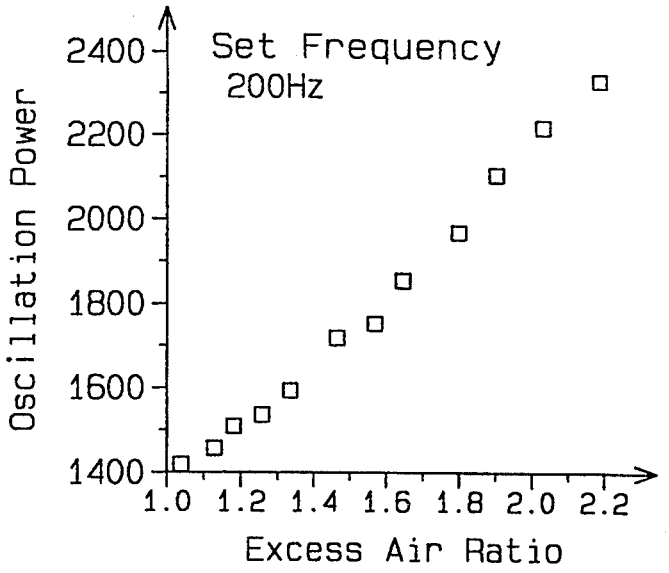
Figure 8:
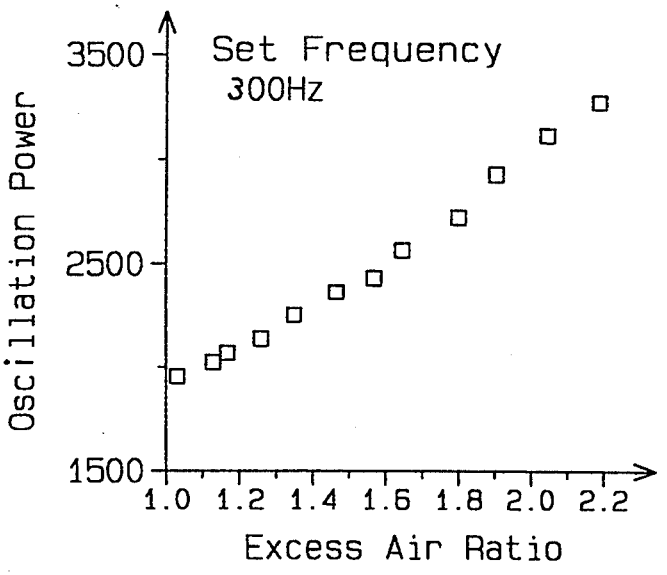

The influence of light intensity has been eliminated, through the processing in the sensor amplifier 27, from the second electric signal which is employed for calculating the oscillation power. Therefore, characteristic of the oscillation power shows a linear correlation with respect to the excess air ratio, without being affected by the signal element of light intensity. FIGS. 7 and 8 indicate the correlations between the excess air ratio and the oscillation power, in the cases where the frequencies for the calculation of oscillation power are 200 Hz and 300 Hz, respectively.

As apparent from these figures, the rectified oscillation power is generally proportional to the excess air ratio. This is consistent with the increment of the fluctuation or disturbance of the turbulent combustion flame, as the excess air ratio increases. That is, as the throughput of air supplied to the burner 5 increases in relation to the increment of the excess air ratio, the flow speed of air increases. As a result, the fluctuation of the turbulent combustion flame increases. The control for the accurate excess air ratio can be achieved by employing this oscillation power.

Figure 4:
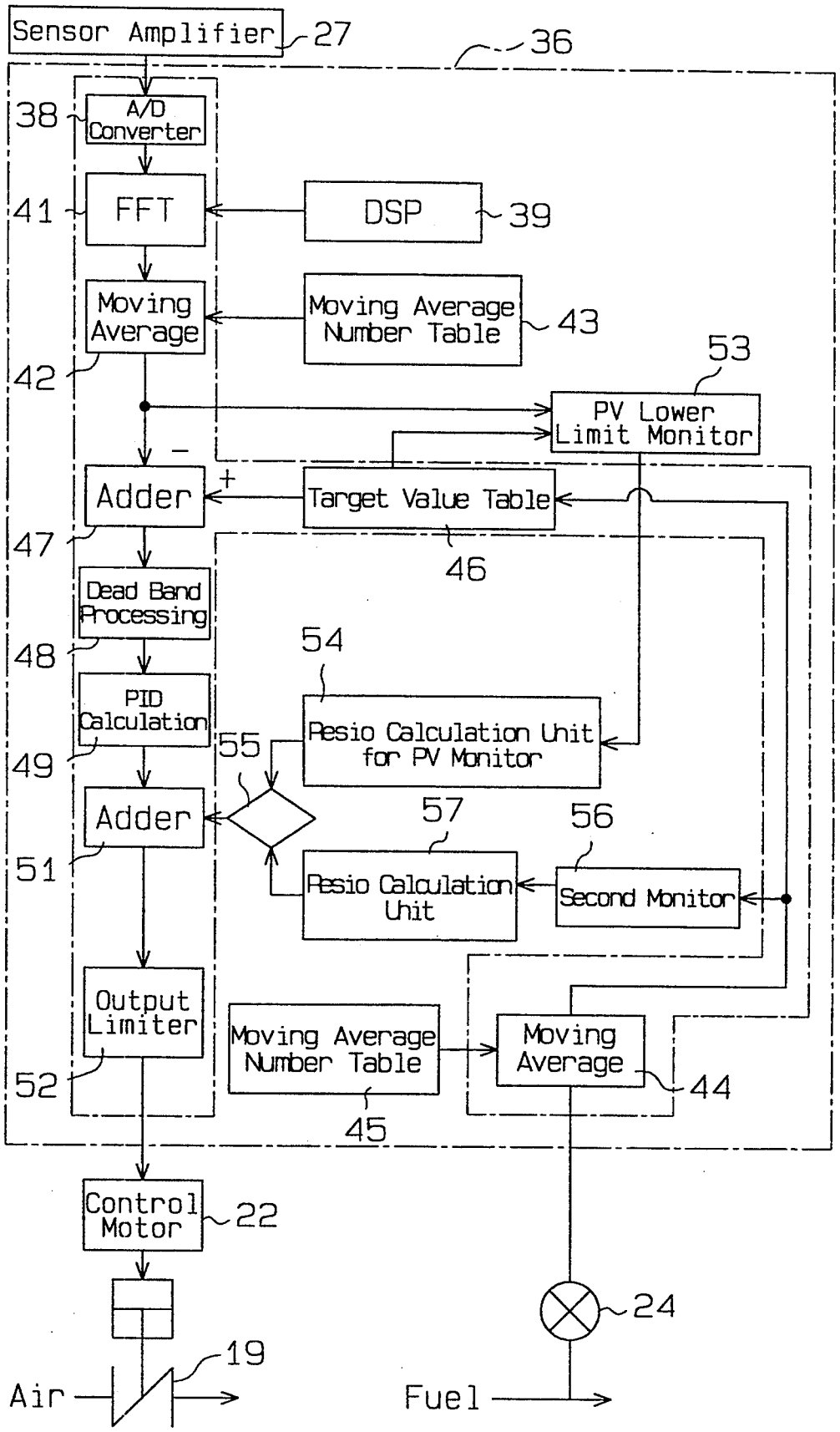

As shown in FIG. 4, a moving average processing unit 42 disposed in the controller 36 averages the oscillation power calculated by means of the FFT processing unit 41, by the predetermined average number which is pre-stored in a moving average number table 43. This averaging process is for minimizing the dispersion generated in the data which are obtained through the FFT processing.

On the other hand, another moving average processing unit 44 disposed in the controller 36 averages the signal indicative of fuel flow, which is transmitted from the flow meter 24, by the predetermined average number which is pre-stored in another moving average number table 45. The controller 36 selects the preferable oscillation power in accordance with the averaged fuel flow, by referring to a target value table 46. The target value table 46 includes the predetermined target values which are set according to the fuel flow. The target values are also the oscillation power which corresponds to the minimum required throughput of air for eliminating the generation of smoke.

An adder 47 disposed in the controller 36 adds the target value of the oscillation power, which is read from the table 46, to the oscillation power obtained by the process in the processing unit 42. In this case, the deviation can be calculated by subtracting the oscillation power from the target power.

A dead band processing unit 48 disposed in the controller 36 performers a dead band process on the deviation signal transmitted from the adder 47. The dead band is pre-set in the unit 48. The controller 36 determines that the signal is not alternating, if the deviation is within the dead band. A PID calculator 49 disposed in the controller 36 performs a PID calculation on the deviation on which the dead band process has been carried out. The PID calculator 49 transmits a signal to a second adder 51, for the purpose of controlling the control motor 22 to eliminate the deviation.

An output limiter 52 disposed in the controller 36 performs a limitation process on a signal transmitted from the adder 51. The limiter 52 includes the predetermined upper and lower limit values. When the signal from the adder 51 exceeds the upper limit value or drops below the lower limit value, the output limiter 52 forcibly converges those signals to the upper limit or lower limit values, respectively. The signal transmitted from the limiter 52 is transmitted to the control motor 22. The motor 22 operates the air control valve 19 to adjust the angle thereof according to the transmitted signal.

The combustion controller 36 further performs the rectification or compensation operation which improves the follow-up to the change of combustion condition and obtains the most preferable excess air ratio while the partial load is applied. The process of this compensation will now be described.

A PV lower limit monitor 53 disposed in the controller 36 determines whether or not the average value of the oscillation power calculated by the processing unit 42 is below the predetermined lower limit value. For example, the value equivalent to −10% of the target value of the oscillation power is set by the target value table 46, and is stored in the monitor 53. When the average value of the oscillation power is lowered below the set value for some reason or other, the monitor 53 detects it.

When the monitor 53 detects that the average value of the oscillation power dropped below the set value, a ratio calculation unit 54 for the PV lower limit monitor 53 executes a ratio calculating operation. A predetermined ratio (e.g., 10%) is stored in the calculation unit 54. A signal indicative of the predetermined ratio is transmitted to the adder 51, via a comparative selector 55. The adder 51 adds the ratio signal to the output signal transmitted from the PID calculator 49. As a result, the air control valve 19 is forcibly opened.

When the average value of the oscillation power calculated in the processing unit 42 dropped below the set value of the monitor 53, the throughput of air to be supplied to the burner is absolutely insufficient. Therefore, the air valve 19 is urgently opened to supply the air, by performing the above-described operation.

The combustion controller 36 further includes a second monitor 56 for detecting the change in the fuel flow. The predetermined rate of change (e.g., 5%) is stored in the second monitor 56. The monitor 56 determines whether or not the rate of change in the fuel flow exceeds the predetermined rate of change, in response to the rapid increase of the fuel flow.

When the second monitor 56 determines that the rate of change in the fuel flow exceeds the predetermined rate of change, a ratio calculation unit 57 for the second monitor 56 executes the ratio calculating operation. A predetermined ratio (%) is pre-stored in the calculation unit 57. A signal relating to the predetermined ratio is transmitted to the adder 51, via the comparative selector 55. Then, the adder 51 adds the signal indicative of the predetermined ratio to the output signal transmitted from the PID calculator 49. As a result, the air valve 19 is forcibly opened.

These operations are executed when it is required that air is promptly supplied to the burner, in order to follow up the rapid change in the fuel flow. When the increment of the throughput of air is insufficient in comparison with the increment of the fuel flow, black smoke may be generated or flame-out may occur. Therefore, the ratio of change of the average value of the output signals transmitted from the flow meter 24 is always monitored by the monitor 56, in order to control the fuel flow. When the rapid increment of the fuel flow, exceeding a predetermined value, is detected, a valve opening signal is added to the PID output signal, such that the air control valve 19 is further opened.

The comparative selector 55 determines which signal has a priority to be selected, when the ratio calculation units 54 and 57 for the monitors 53 and 56 are simultaneously operated. According to this embodiment, the selector 55 selects the signal having a larger absolute value out of those two signals.

In this way, a slightly larger amount of air than the preferable amount is supplied to the burner 5, in order to prevent the air shortage beforehand. As the fuel flow increases, the throughput of air is also increased to follow-up the fuel increment.

According to this embodiment, before the FFT processing is carried out, the oscillation signal element is divided by the signal element of light intensity by means of the analog divider 33, thereby to produce a rectified signal excluding the influence originating from the intensity of light. Compensated oscillation power can be obtained by carrying out the FFT processing based on the rectified signal. Accordingly, the rectified signal includes only a factor originating in the turbulent combustion flame (F).

Therefore, the power spectrum at the most preferable combustion state has an approximately similar shape regardless of combustion condition. In other words, the compensated oscillation power at the most preferable combustion state becomes stabilized regardless of combustion condition. As a result, regardless of the set frequency for FFT processing, the oscillation power can have linear characteristic (i.e., linear functional characteristic) with respect to the excess air ratio. The present invention, by providing an exact and effective control of excess air ratio, can be employed in any type of boiler, unlike the conventional arts which can be employed in limited type of boilers.

SECOND EMBODIMENT

The second embodiment of the present invention embodied in an industrial furnace will now be described by referring to FIGS. 9 through 15. This industrial furnace is a combustion apparatus for applying heat treatment to work pieces which are intermediate products. The heat treatment carried out by this apparatus includes cementation hardening for steel parts, ceramic baking or sintering, and melting of metals such as aluminum or pig iron.

Figure 9:
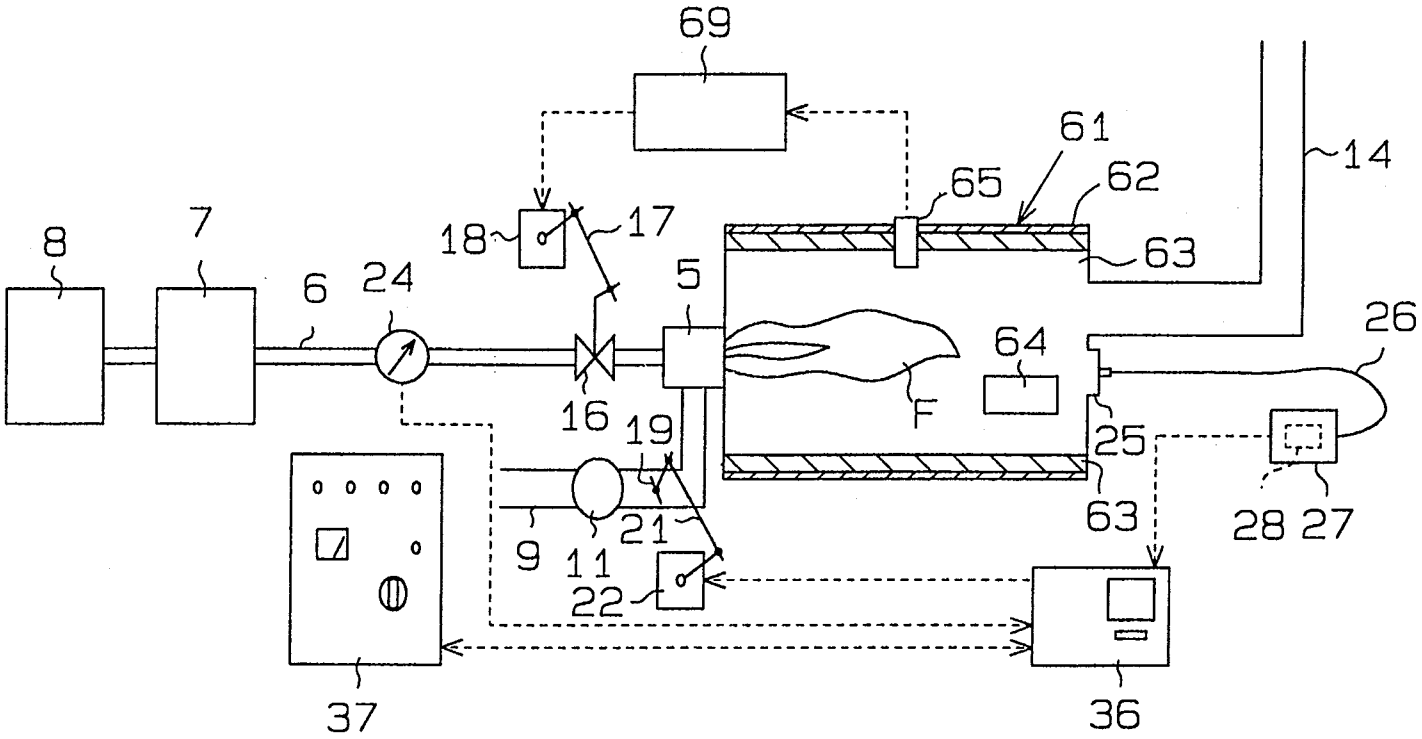

FIG. 9 shows an entire structure of a combustion facility including an industrial furnace 61. A furnace body 62 of the industrial furnace 61 has a generally box shape which extends side ways. The furnace body 62 includes refractory material 63, such as refractory bricks, fit in the inside walls. Since the refractory material 63 can reserve heat generated by the combustion flame from the burner 5, temperature of the refractory material 63 reaches approximately 900° C. to 1000° C. which is higher than that of the furnace wall 15 of the boiler 1 according to the first embodiment.

A transport machine or conveyor (not shown) is disposed within the furnace body 62. The transport machine conveys a plurality of work pieces 64 in the direction perpendicular to the drawing surface. The heat treatment is carried out on each one of the work pieces 64 while the work pieces 64 are transported. A temperature sensor 65 is provided on the furnace body 62, instead of the pressure gauge 23 according to the first embodiment. The sensor 65 detects the internal temperature of the furnace body 62. The sensor 65 is connected to a temperature controller 69 which is connected with the control motor 18. The controller 69 transmits a drive control signal to the motor 18 based on a temperature signal transmitted from the sensor 65. The opening angle of the fuel control valve 16 is adjusted according to the drive control signal. As a result, the flow of fuel to the burner 5 is regulated, such that the internal temperature in the furnace body 62 is controlled to maintain a predetermined temperature.

The structure of combustion facilities according to this embodiment is similar to that of the first embodiment, except as otherwise described. Therefore, to simplify the description, similar numerical reference numbers are given to the same components as those of the first embodiment.

The function of the sensor amplifier 27 according to the second embodiment differs from that of the amplifier 27 employed in the first embodiment. Because the optical sensor 28, which is provided with an infrared rays detecting element, detects many infrared rays originating in radiation from the high temperature materials (i.e., mainly refractory material 63 and work pieces 64) in addition to infrared rays directly transmitted from the combustion flame (F). The second embodiment will provide a method which can obtain an accurate oscillation power based on the fluctuation of the turbulent combustion flame, regardless of the disturbance of such radiation heat.

The influence caused by heat radiation excluding that from the combustion flame (F) of the burner will now be described in detail.

Figure 12A:
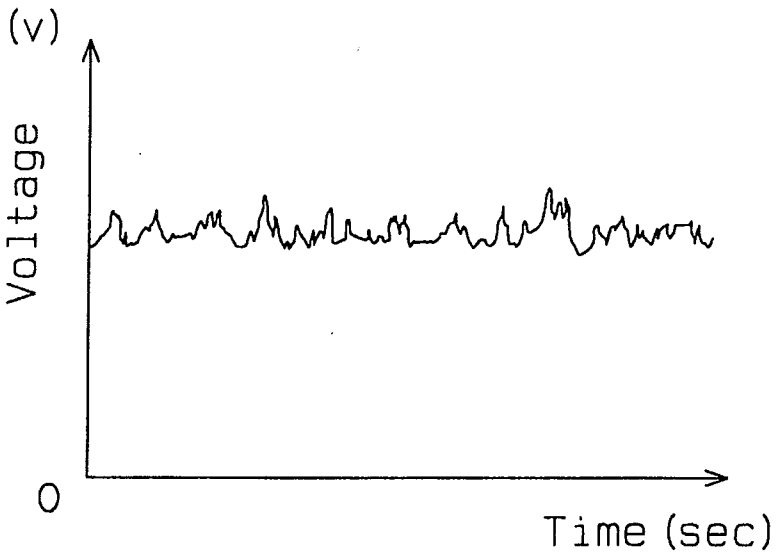
Figure 12B:
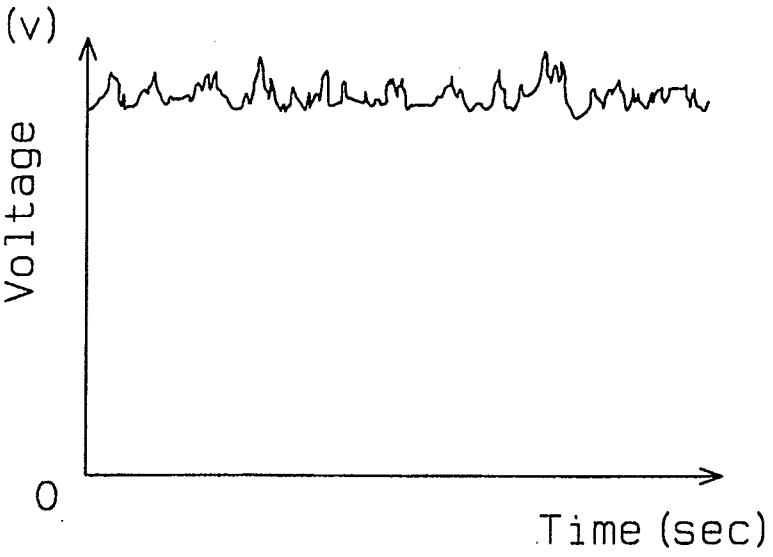
FIG. 12B is a waveform chart of electric signal DC/AC-converted in the case where radiation influence exists.

FIGS. 12A and 12B show waveform of signals from the sensor 28, to which the current/voltage conversion is applied. FIG. 12A shows waveform in the case where no radiation heat exists besides that from the combustion flame (F). FIG. 12B shows a waveform in the case where there is great radiation heat from the materials disposed in the furnace. The combustion conditions in cases of FIGS. 12A and 12B, including the flow of fuel and the excess air ratio, are identical. When the radiation heat from the materials in addition to the combustion flame (F) is great as shown in FIG. 12B, the voltage value of the signal element of light intensity is higher than that in the case of FIG. 12A where such radiation heat does not exist. However, in the two cases, amplitudes of oscillation signal elements are generally identical. In other words, the prerequisite does not exist, on which the method according to the first embodiment depends (i.e., the amplitude of oscillation signal element is substantially proportional to the intensity of light).

The furnace wall 15 of the boiler 1 in the first embodiment is the water cooled wall, such that the temperature of the wall 15 will not rise very high even when the boiler is operating. Accordingly, the wall 15 generates hardly any radiation heat. As a result, the optical sensor 28 for the boiler 1 will be hardly affected by the radiation heat originating in the wall 15.

However, the internal temperature of the furnace body 62 according to the second embodiment is significantly high. Accordingly, the refractory material 63 and work pieces 64 generate large amount of radiation heat which can not be neglected. Therefore, the optical sensor 28 for the industrial furnace 61 detects radiation heat (infrared rays) transmitted from the high temperature materials disposed in the furnace 6! in addition to heat directly transmitted from the combustion flame (F). Then, the oscillation power calculated on the basis of the signal transmitted from the optical sensor 28 for the industrial furnace 61 does not reflect the actual combustion condition of the furnace, but reflects the condition including disturbance. The oscillation power including disturbance is not preferable as an indicator for the purpose of the combustion control.

Figure 13A:
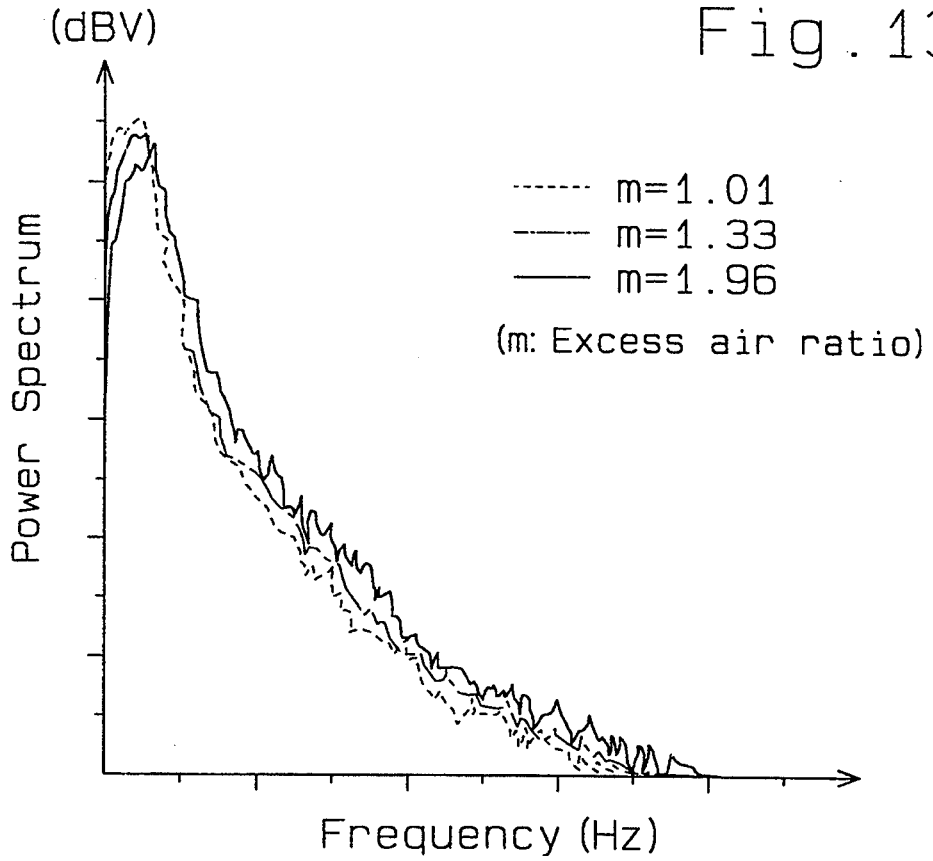

FIG. 13A shows power spectra of various frequencies at various excess air ratio, respectively. Of course, the power spectra is obtained by dividing the oscillation signal element by the signal element of light intensity and applying the FFT processing to its divided signal. According to the graph, the power spectra in the low frequency region varies with at each excess air ratio. On the other hand, the power spectra in the remaining frequency regions including high frequency regions have hardly any difference at every excess air ratio. This is due to the variation of apparent amplitude of the oscillation signal element, in accordance with the variation of the flame temperature as excess air ratio is changed.

Figure 14A:
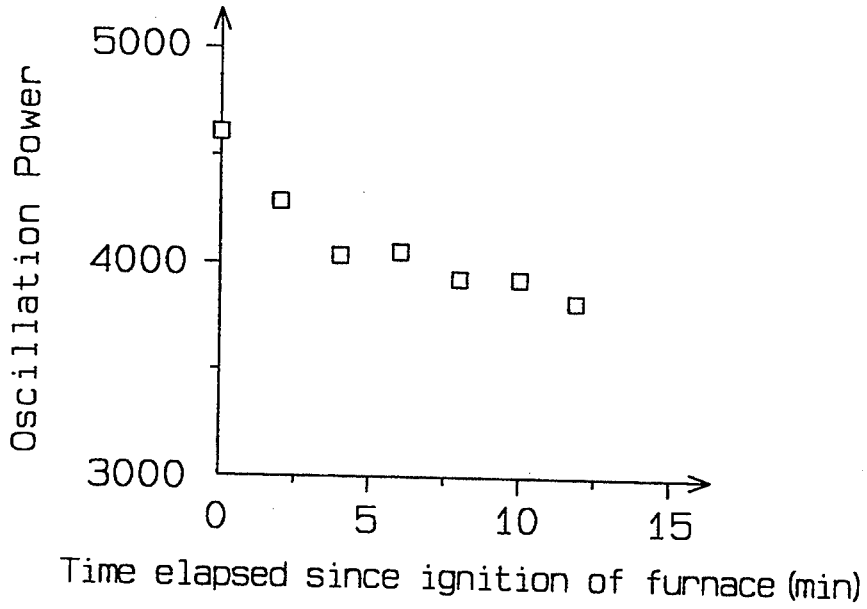

FIG. 14A shows a graph of oscillation power at the elapsed time from ignition of the furnace, when metal pieces (i.e., corresponds to the work pieces 64) are heated up in the industrial furnace 61 under a certain combustion condition. The oscillation power in FIG. 14A is originates in the electric signal obtained by dividing an oscillation signal element by a signal element of light intensity, like the first embodiment. According to FIG. 14A, although the combustion condition is kept constant, the oscillation power gradually decreases as time elapses. This phenomenon is due to the increment of the signal element of light intensity (i.e., increment of the denominator for the division), in accordance with the increment of heat radiation as time elapses. Therefore, when the temperature of the furnace wall greatly varies until the combustion apparatus reaches a steady operating state since the ignition thereof, the control of the excess air ratio, utilizing the oscillation power, is extremely difficult or unsuitable.

In order to solve the drawbacks shown in FIGS. 13A and 14A, according to the second embodiment, the oscillation signal element of the detected signal by the sensor 28 is compensated by the value or signal obtained from the oscillation signal element, which is not disturbed by heat radiation of any high temperature material, instead of the signal element of light intensity of the detected signal. Described in detail, the oscillation signal element of the detected signal by the sensor 28 is divided by the average value of the amplitude of the oscillation signal element.

The method according to the second embodiment depends on two facts as follows:

(1) The oscillation signal element is proportionally increased in accordance with the increase of the signal element of light intensity, as the temperature of the combustion flame (F) rises up; and (2) The oscillation signal element of the detected signal by the sensor 28 is hardly influenced by radiation heat from the refractory material 63 and work pieces 64, even if the signal element of light intensity is influenced by such radiation heat.

Figure 10:
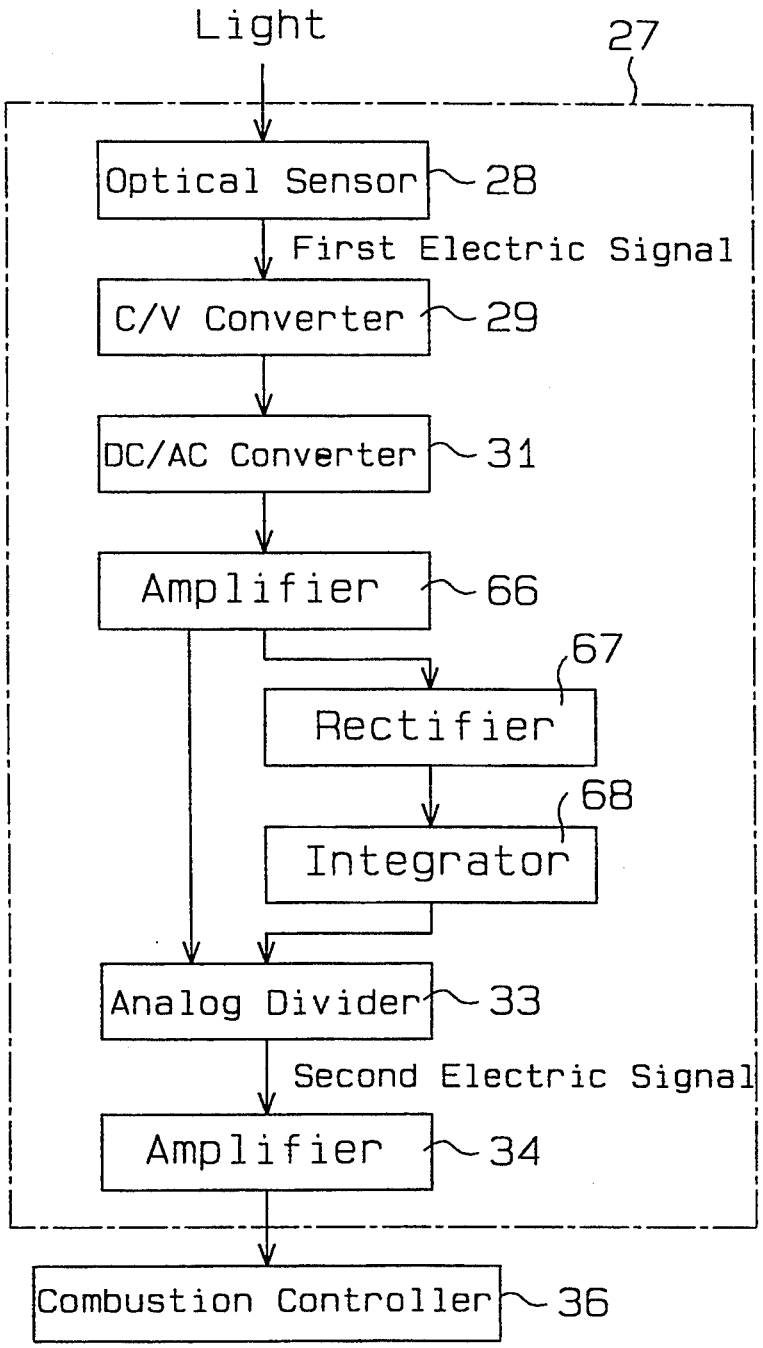

FIG. 10 is a functional block diagram which corresponds to FIG. 3 according to the first embodiment. The sensor amplifier 27 according to the second embodiment internally includes an optical sensor 28, a current-voltage converter 29, a DC/AC converter 31, an amplifier 66, a rectifier 67, an integrator 68, an analog divider 33 and an amplifier 34. The electric signal transmitted from the sensor 28 is processed according to various operations by means of those described devices. It will be described in detail.

The optical sensor 28 converts the combustion flame of the burner 5 taken in through the optical fiber 26 into the respective electric signal (current). The electric signal is converted into the voltage signal shown in FIG. 11A, by means of the C/V converter 29. This voltage signal oscillates with respect to a certain DC voltage value as time elapses. The DC/AC converter 31 converts only the oscillation signal element in the signal shown in FIG. 11A to an AC voltage signal. The AC voltage signal is amplified by means of the amplifier 66. Thus, the oscillation signal element shown in FIG. 11B is extracted from the electric signal transmitted from the optical sensor 28.

Figure 11A:
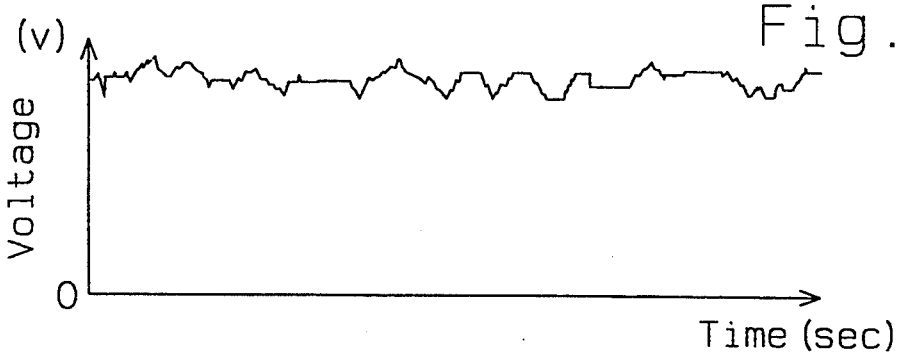
FIGS. 11A, 11B, 11C, 11D and 11E are waveform charts of various electric signals to be processed in the sensor amplifier of FIG. 10.
Figure 11B:
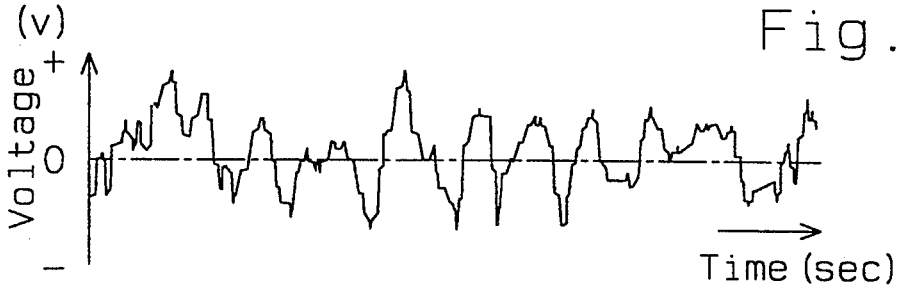
Figure 11C:
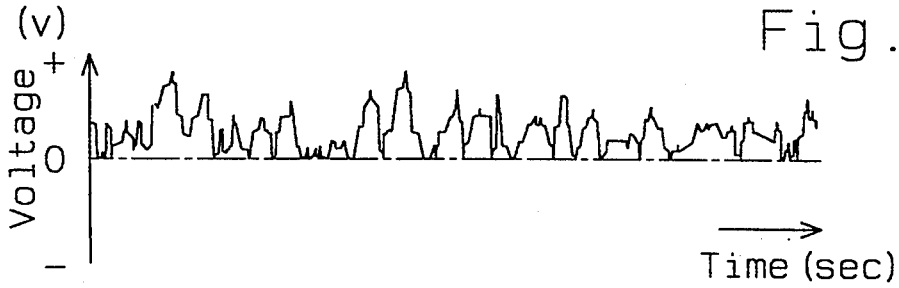

The rectifier 67 carries out a rectification or commutation process on the signal shown in FIG. 11B. By the rectification, the AC voltage signal is converted into the DC voltage signal shown in FIG. 11C. The integrator 68 then carries out an integration on the DC signal shown in FIG. 11C. The integral time will be set according to type and/or condition of the facilities including the combustion apparatus. If the integral time is exceptionally long, a response of the combustion control against the change of combustion condition may become unsatisfactory. Therefore, it is preferable that the integral time is set to approximately one second, considering the response of control.

Figure 11D:
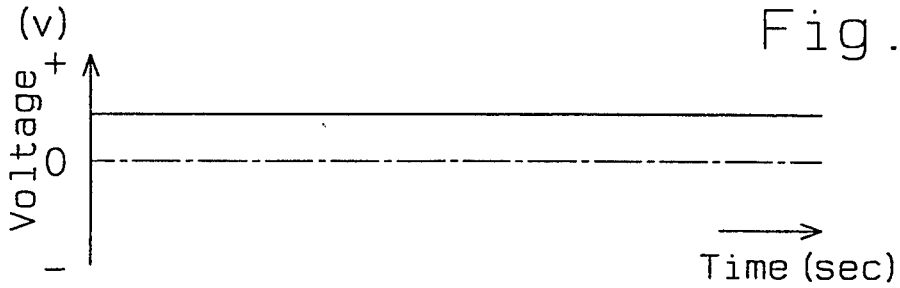

The rectified DC voltage signal is converted into a smooth signal as shown in FIG. 11D. This smoothed signal represents the average value of the oscillation signal element, and reflects or represents a real intensity of radiated light from the combustion flame. The average value of the oscillation signal element is referred to as "Representative Factor of Light Intensity", hereinafter. The Representative Factor of Light Intensity does not includes any influence caused by the heat radiation from the high temperature materials disposed in the furnace body. It keeps a constant value, as long as the condition of the combustion flame (F) is steady.

Figure 11E:
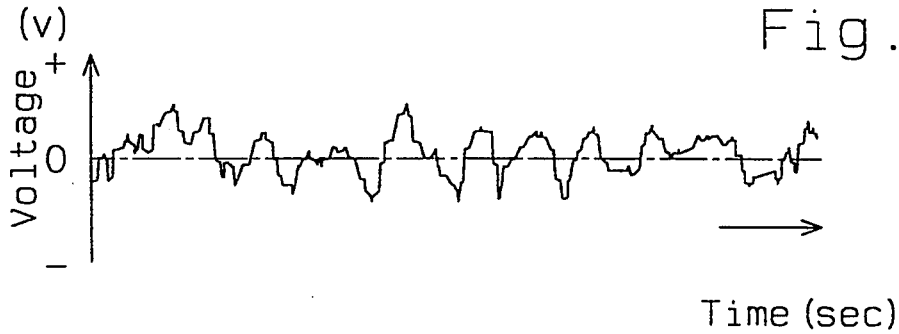

The amplitude of the oscillation signal element shown in FIG. 11B is correlated with the magnitude of the Representative Factor of Light Intensity shown in FIG. 11D. Accordingly, the divider 33 can divide the oscillation signal element by the Representative Factor of Light Intensity, thereby producing an electric signal as shown in FIG. 11E, in which the influence caused by the intensity of light is quantitatively compensated.

The electric signal after the division includes relative low frequency signal elements having certain amplitude of oscillation, and relative high frequency signal elements having smaller amplitudes than those of the low frequency signal elements. Of course, the electric signal is free from the unfavorable influence caused by the radiation heat, and is based on only the state of the combustion flame (F). Then, the amplifier 34 amplifies the compensated signal somewhat, and transmits the amplified signal to the combustion controller 36.

Figure 13B:
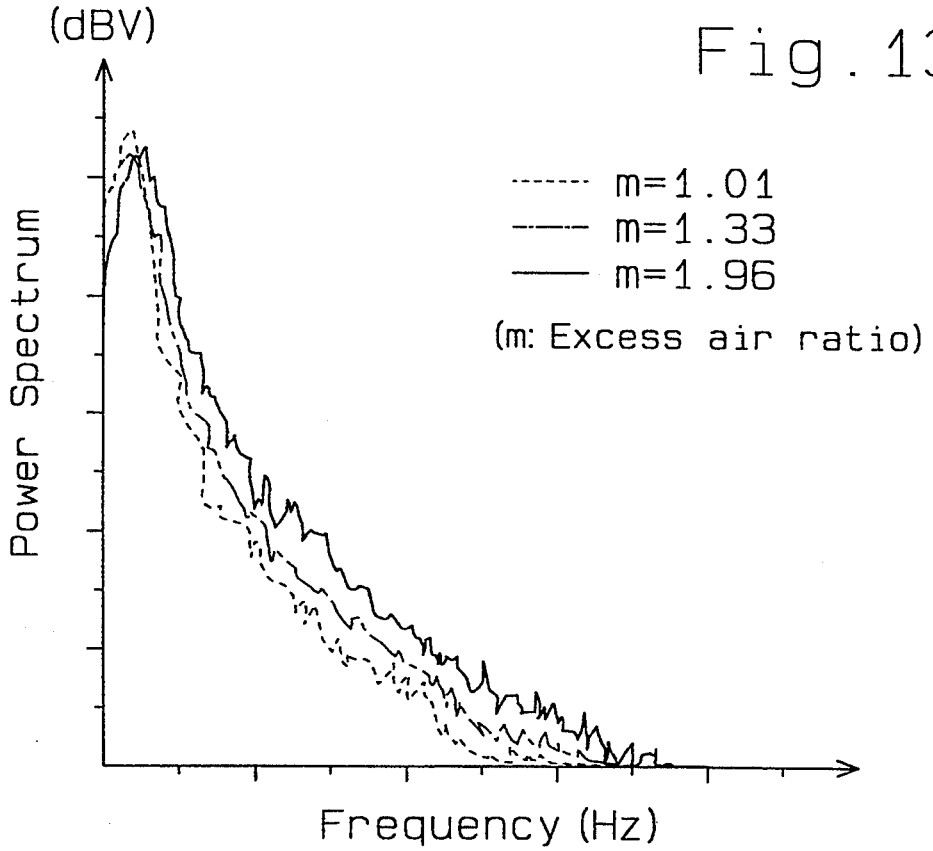
FIG. 13B is a graph illustrating the relationship between frequency and power spectrum in the case where radiation influence exists.

The function of the controller 36 according to the second embodiment is similar to that of the first embodiment. FIG. 13B shows the power spectra of various frequencies, which can be obtained through the FFT processing in the second embodiment. Apparent from FIG. 13B, each one of the power spectra is generally similar to one another in the low frequency region, regardless of respective excess air ratio. This suggests that the standard amplitude of the oscillation signal element is compensated to obtain the generally constant value by the compensation of the influence originated in the intensity of radiated light. Further, according to FIG. 13B, as the excess air ratio increases, power spectrum appear in the much higher frequency. This indicates that the high frequency fluctuation of the turbulent combustion flame increases, as the amount of air increases.

Figure 14B:
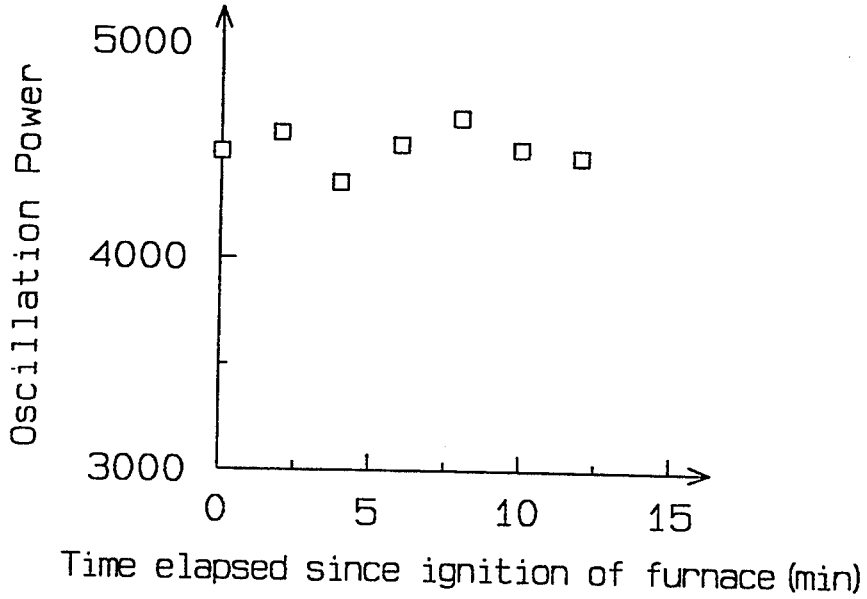
FIG. 14B is a graph illustrating the change of oscillation power as time elapses when the radiation influence is rectified in the manner of the second embodiment.
Figure 15:
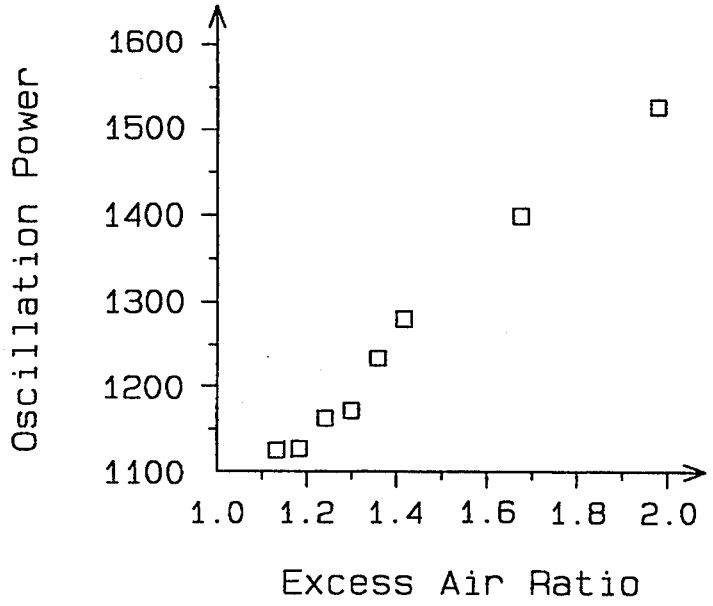

FIG. 15 is a graph showing the correlation between the excess air ratio and the oscillation power according to the second embodiment. Apparent from this graph, there is a linear relationship between them. FIG. 14B shows the correlation between the oscillation power and the elapsed time, when the measurement is conducted under the similar combustion condition to that in the case of FIGS. 13A and 14A. Although the oscillation power in FIG. 14A decreases as time elapses, the oscillation power in FIG. 14B keeps a substantially constant level, regardless of the elapsed time.

The characteristic of the oscillation power as shown in FIG. 14B (i.e., generally keeping the power value constant under a certain constant combustion condition) is very preferable for the excess air ratio control of the combustion apparatus. In other words, the oscillation power obtained by the method according to the second embodiment is, the most preferable and reliable, as an indicator for the excess air ratio control.

According to the second embodiment, the oscillation power is calculated on the basis of the compensated signal by dividing the oscillation signal element by the Representative Factor Light Intensity, which is obtained from the oscillation signal element. Accordingly, the oscillation power reflects the real combustion condition excluding the disturbance of heat radiation originated from high temperature materials. In addition, the oscillation power corresponds to the excess air ratio in the one-to-one correspondence manner.

Other signal, value or amount representing the amplitude of the oscillation signal element can be employed as "Representative Factor of Light Intensity", in place of the signal obtained by integrating the rectified DC voltage signal from the rectifier 67. For example, the followings can be exemplified as such other signal, value or amount:

(1) Maximum value of amplitude in the oscillation signal as shown in FIG. 11B;

(2) Value given by squaring the amplitude (i.e., voltage value) of an oscillation signal shown in FIG. 11B at a predetermined time interval; and (3) Square root of the above-described value given by squaring.

THIRD EMBODIMENT

Figure 16:
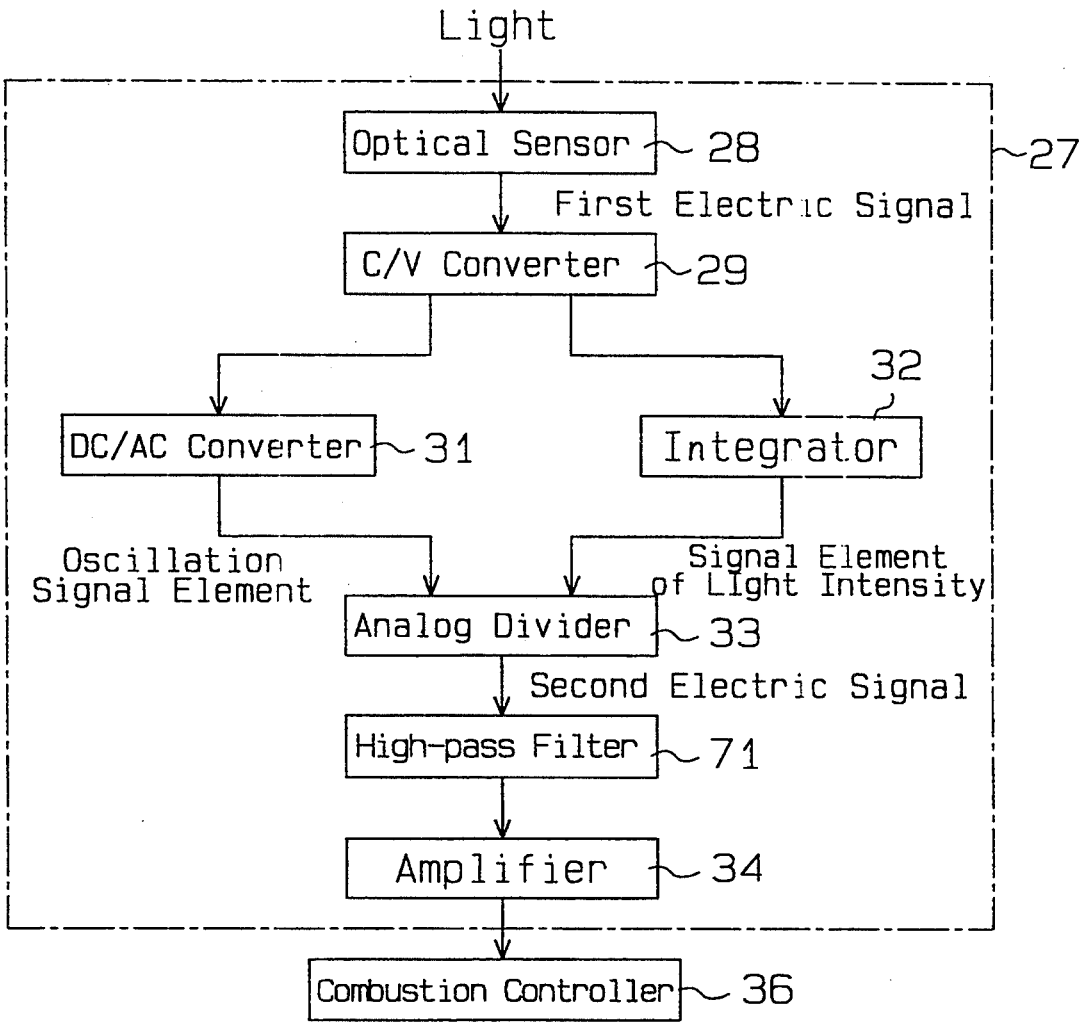

The third embodiment according to the present invention will now be described referring to FIGS. 16 through 21. As shown in FIG. 16, the sensor amplifier 27 according to the third embodiment includes an additional high-pass filter 71 disposed midway between the analog divider 33 and amplifier 34 in the sensor amplifier 27 of the first embodiment. Similar to the first embodiment, the analog divider 33 divides the oscillation signal element from the DC/AC converter 31 by the signal element of light intensity from the integrator 32. The high-pass filter 71 removes relative low frequency signal elements existing in the signal transmitted from the divider 33, and maintains only relative high frequency signal elements. The remaining high frequency signal elements are amplified by means of the amplifier 34. The circuit constitution of the third embodiment is similar to that of the first embodiment, except for the high-pass filter 71. The signal transmitted from the optical sensor 28 is therefore processed in the same manner as the first embodiment, except for the filtration by the filter 71.

Figure 19:
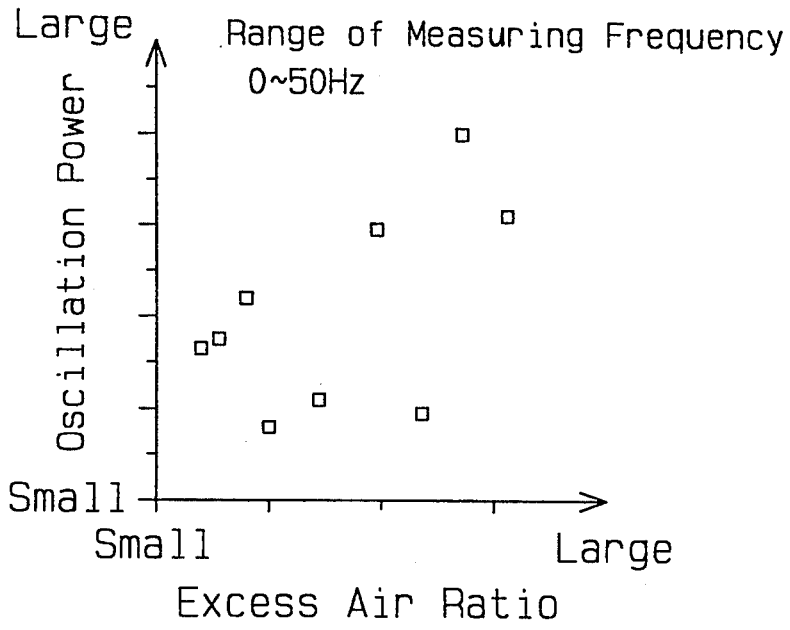

The requirement of the high-pass filter 71 will now be described. It is found, through the measurement by an independent FFT analyzer distinguished from the combustion controller 36, that a linear relationship between oscillation power and excess air ratio may not be formed only by dividing the oscillation signal element by the signal element of light intensity. For example, when the upper limit of the measuring frequency range at FFT processing is set to below 50 Hz, the oscillation power is significantly influenced by the change of combustion condition, rather than by the change of flame fluctuation due to the change of excess air ratio. Consequently, as shown in FIG. 19, the correlation between oscillation power and excess air ratio will diminish or disappear. Furthermore, in some types of combustion apparatus, the influence originating from the intensity of light may be incompletely excluded from obtained oscillation power. In such case, the oscillation power will not always become linear with respect to the excess air ratio.

In order to realize a linear functional relation between the oscillation power and the excess air ratio, an upper limit of the measuring frequency range at the FFT process should be set to a high value (e.g., above 200 Hz). When the upper limit is set to such high value, the characteristic of the oscillation power with respect to the excess air ratio will become linear, regardless of kinds or types of combustion apparatus.

In the combustion controller 36 according to the first embodiment, the upper limit of the measuring frequency range for FFT process can be set to 500 Hz. Therefore, the controller 36 can satisfy the above-described requirement (i.e., the upper limit should be set to the value above 200 Hz). The electric signal transmitted from the C/V converter 29 in the sensor amplifier 27 is a combination signal including various basic waveforms having different frequencies and amplitudes of oscillation. Furthermore, each of the amplitudes of the various basic waveforms is inversely proportional to the frequency of the basic waveform.

When the amplifier 34 disposed in the sensor amplifier 27 amplifies a signal, the amplification factor is adjusted such that the maximum amplitude of the electric signal could be within the allowable input voltage range ($\pm 2.5$V), while the relative low frequency signal having a relative larger amplitude is used as a standard, as shown in FIG. 17. The amplitude of the relative high frequency signal in the amplified electric signal is relatively small in comparison with that of the relative low frequency signal. Therefore, the high frequency signal may not be detected by the A/D converter 38 with small resolution, which is disposed in the combustion controller 36.

In this case, even when the digital signal transmitted from the A/D converter 38 is processed through the FFT processing, power spectra can be obtained only in the range between zero Hz and approximately 80 Hz. As a result, the oscillation power calculated based on these power spectra will not be linear with respect to the excess air ratio. To obtain the power spectra in the wide frequency range between zero Hz and approximately 500 Hz, it may be proposed to increase the resolution of the A/D converter 38, or to make the calculation accuracy of the DSP 39 more precise. However, these improvements make the controller 36 itself very expensive.

In view of above-described point, the sensor amplifier 27 according to the third embodiment includes the additional high-pass filter 71. Prior to the signal processing executed by the amplifier 34, the relative low frequency signal in the electric signal from the analog divider 33 is removed by means of the high-pass filter 71. Consequently, only the relatively high frequency signal is extracted from the electric signal.

FIG. 16 corresponds to FIG. 3 in the first embodiment, and shows the processing carried out by the sensor amplifier 27. The analog divider 33 divides the oscillation signal element from the DC/AC converter 31 by the signal element of light intensity from the integrator 32. The low frequency element in the divided signal is removed by the high-pass filter 71, and only the high frequency element can be extracted. Since the cut-off frequency of the filter 71 is arbitrarily assignable, it can be preferably assigned in accordance with the condition of the boiler 1. The cut-off frequency is normally assigned around 20 Hz.

Figure 17A:
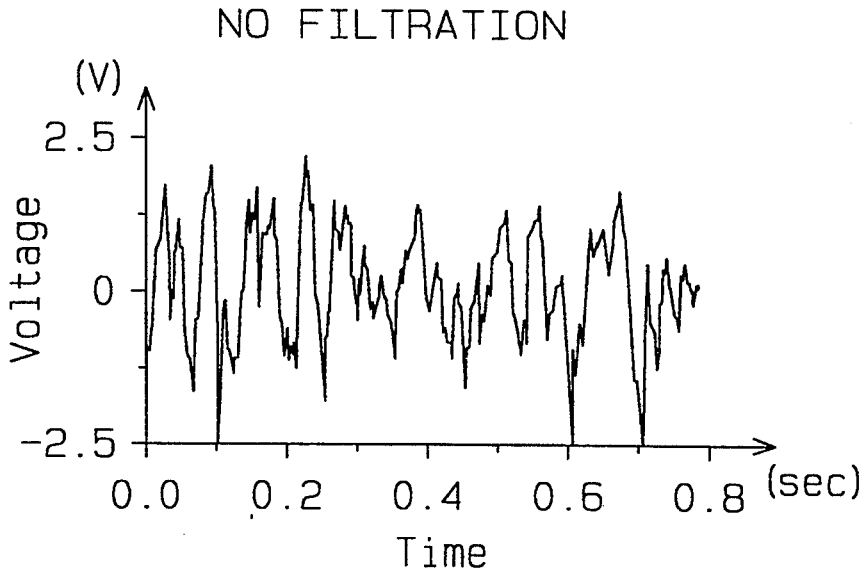
Figure 17B:
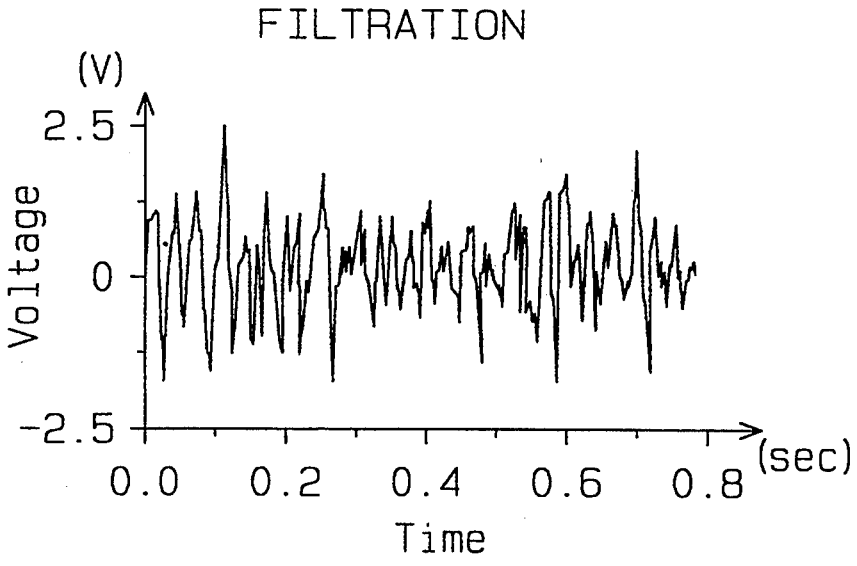
FIG. 17B is a waveform chart of the electric signal after having been processed by the high-pass filter.

The remaining high frequency signal is amplified to a predetermined level by means of the amplifier 34. Since the allowable input voltage for the controller 36 is in the range of ±2.5V, the amplifier 34 controls an amplification factor such that the maximum amplitude of the high frequency signal never exceeds ±2.5V, as shown in FIG. 17B. If the electric signal before amplifying had included a low frequency signal less than 20 Hz, the signal from the analog divider 33 would be amplified on the basis of the low frequency signal, because the amplitude of the low frequency signal is larger than that of the high frequency signal. Then, the amplitude of the high frequency signal would be insufficiently amplified (referring to FIG. 17A).

However, according to the third embodiment, the high-pass filter 71 extracts only the signal in the relative high frequency region (above 20 Hz) out of the electric signal transmitted from the analog divider 33. The amplifier 34 amplifies the amplitude of the electric signal transmitted from the divider 33 to an adequate level, on the basis of the amplitude of the high frequency signal. The amplified analog signal is transmitted from the sensor amplifier 27 to the controller 36.

The combustion controller 36 according to the third embodiment performs processing similar to that performed by the controller 36 according to the first embodiment.

Figure 18A:
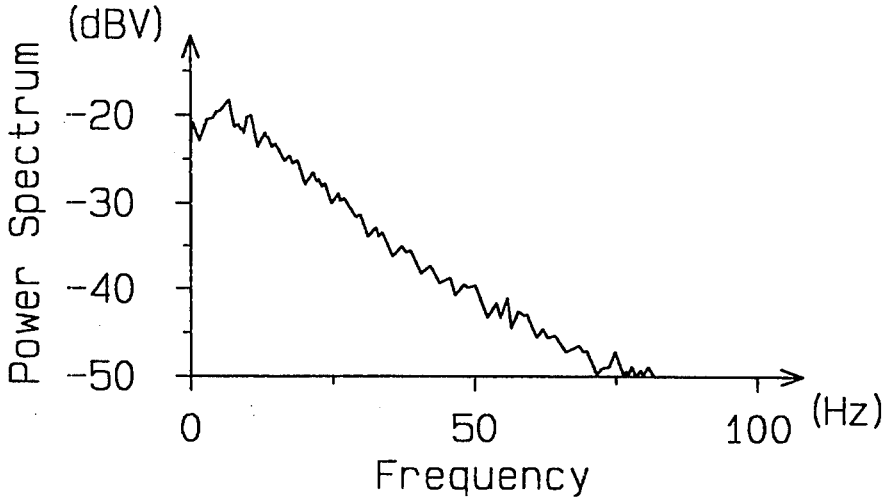
Figure 18B:
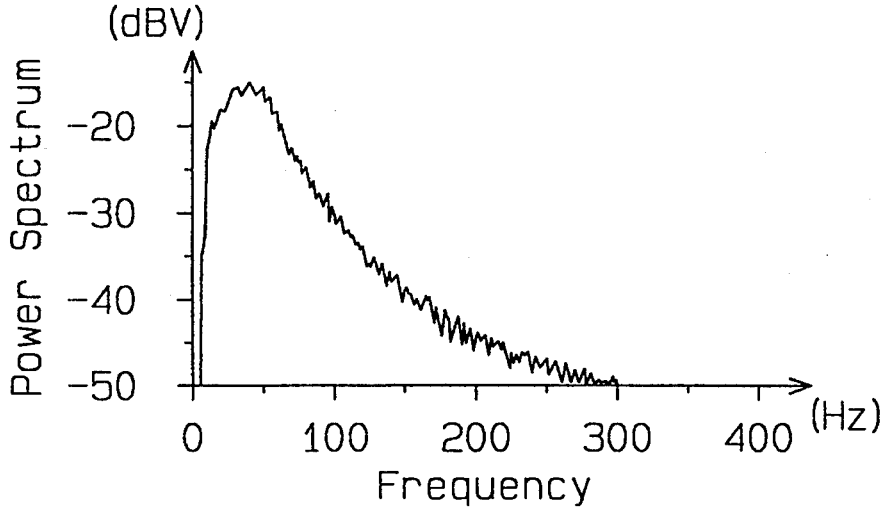
FIG. 18B is a graph illustrating the result of frequency analysis based on the electric signal after having been processed with the high-pass filter.

The electric signal input to the controller 36 has been quantitatively compensated through the signal processing in the sensor amplifier 27, in connection with the influence of light intensity to the amplitude of the oscillation signal element. In addition, any electric signal in the whole measuring frequency range is sufficiently amplified by the amplifier 34. The power spectra after the FFT process have a waveform wherein the low frequency region (0 through 20 Hz) is removed, as shown in FIG. 18B. The maximum frequency (approximately 300 Hz in FIG. 18B) where the power spectrum will appear in the third embodiment is higher than that (approximately 80 Hz in FIG. 18A) in the case without the filtration by a high-pass filter.

The FFT processing unit 41 of the combustion controller 36 calculates the oscillation power by integrating the power spectra in FIG. 18B, similar to the first embodiment. Since the oscillation power is calculated based on the power spectra in which the influence of the intensity of light is excluded by including the high frequency signal element, the correlation between the oscillation power and the excess air ratio becomes linear.

Figure 20:
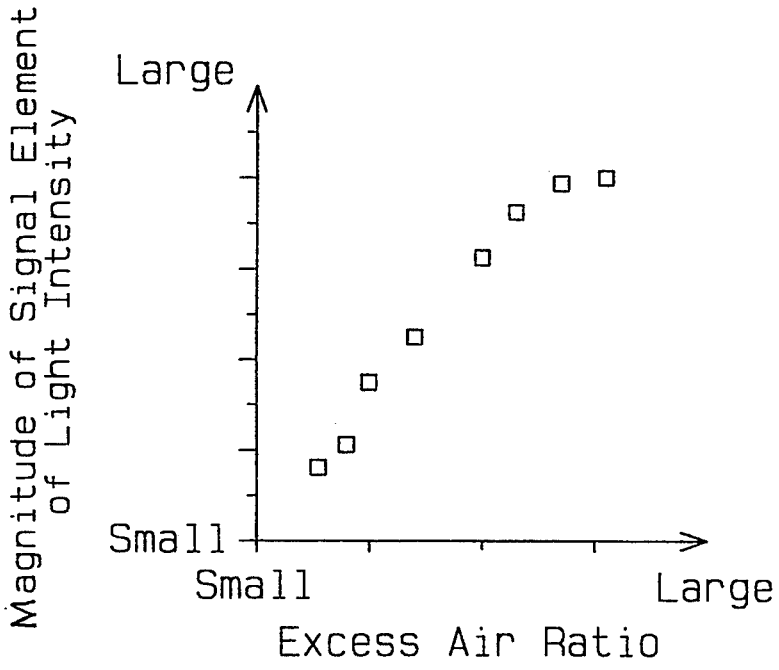

FIG. 20 shows the relationship between the excess air ratio and the signal element of the intensity of light originated in the combustion flame, when a flue and smoke tube boiler using "heavy fuel oil A", which is designed to generate five tones of steam per hour, is operated at the combustion rate of 360 liters per hour.

Figure 21A:
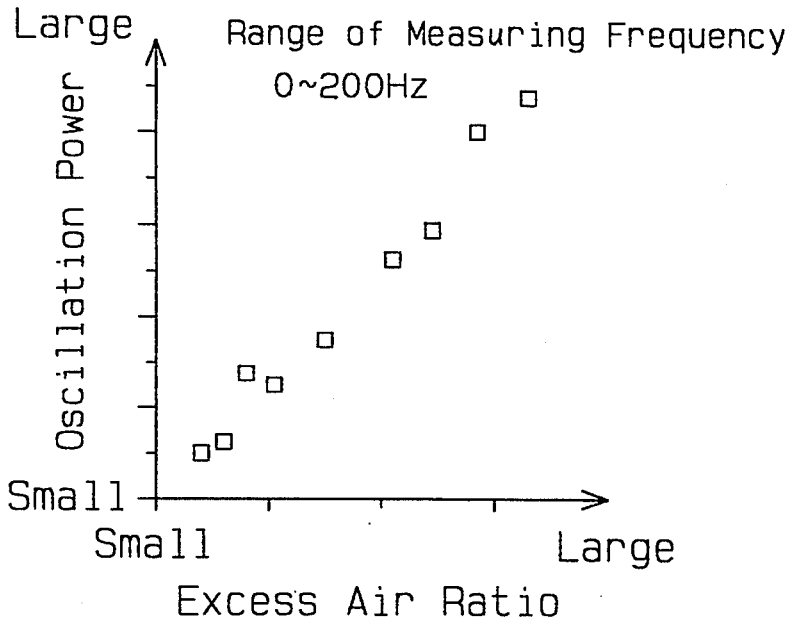
Figure 21B:
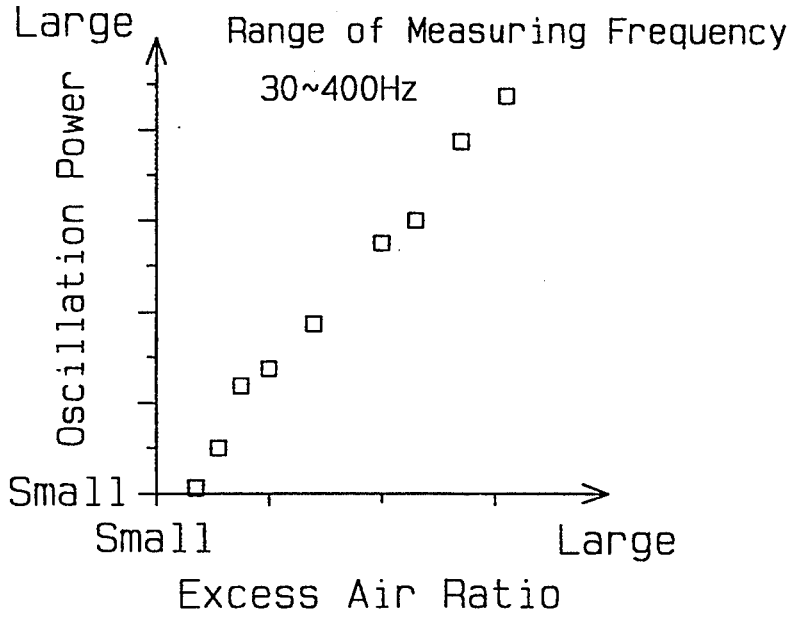
FIG. 21B is a graph illustrating the relationship between excess air ratio and oscillation power when the signal of FIG. 20 is FFT-processed with the combustion controller of the third embodiment.

After the various operations (i.e., division and amplification) are carried out on the basis of the signal element of light intensity by the sensor amplifier 27 (without any high-pass filters) in the first embodiment, an independent FFT analyzer applies the FFT processing to the output signal transmitted from the sensor amplifier 27. The measuring frequency range by the analyzer is set between zero Hz and 200 Hz. FIG. 21A shows the relationship between the excess air ratio and the oscillation power obtained through the FFT processing by the analyzer. As is apparent from this figure, there is a positive correlation between the oscillation power and the excess air ratio, when the upper limit of the measuring frequency range is set at a high value.

on the contrary, after various signal processing are carried out on the basis of the signal element of light intensity shown in FIG. 20, by means of the sensor amplifier 27 including the high-pass filter 71 according to the third embodiment, the combustion controller 36 according to the third embodiment applies the FFT processing to the output signal transmitted from the sensor amplifier 27. At this time, the measuring frequency range is between 30 Hz and 400 Hz. FIG. 21B shows the correlation between the excess air ratio and the oscillation power obtained through the FFT processing.

As is apparent from the comparison of FIG. 21A with FIG. 21B, even when the relatively low frequency signal is cut-off from the signal to be input to the amplifier 34, the correlation between the oscillation power and the excess air ratio never diminishes. Therefore, the method according to the third embodiment can be utilized with high confidence, for the purpose of the excess air ratio control for the combustion apparatus.

According to the third embodiment, the simple improvement of adding the high-pass filter 71 permits the combustion controller 36 to obtain the power spectra including the high frequency signal element, thereby causing the linear relationship between the oscillation power and the excess air ratio.

It is easily understood that the high-pass filter 71 according to the third embodiment can be employed in the sensor amplifier 27 according to the second embodiment. Then, a high-pass filter can be disposed midway between the analog divider 33 and the amplifier 34, which are shown in FIG. 10.

FOURTH EMBODIMENT

Figure 22:
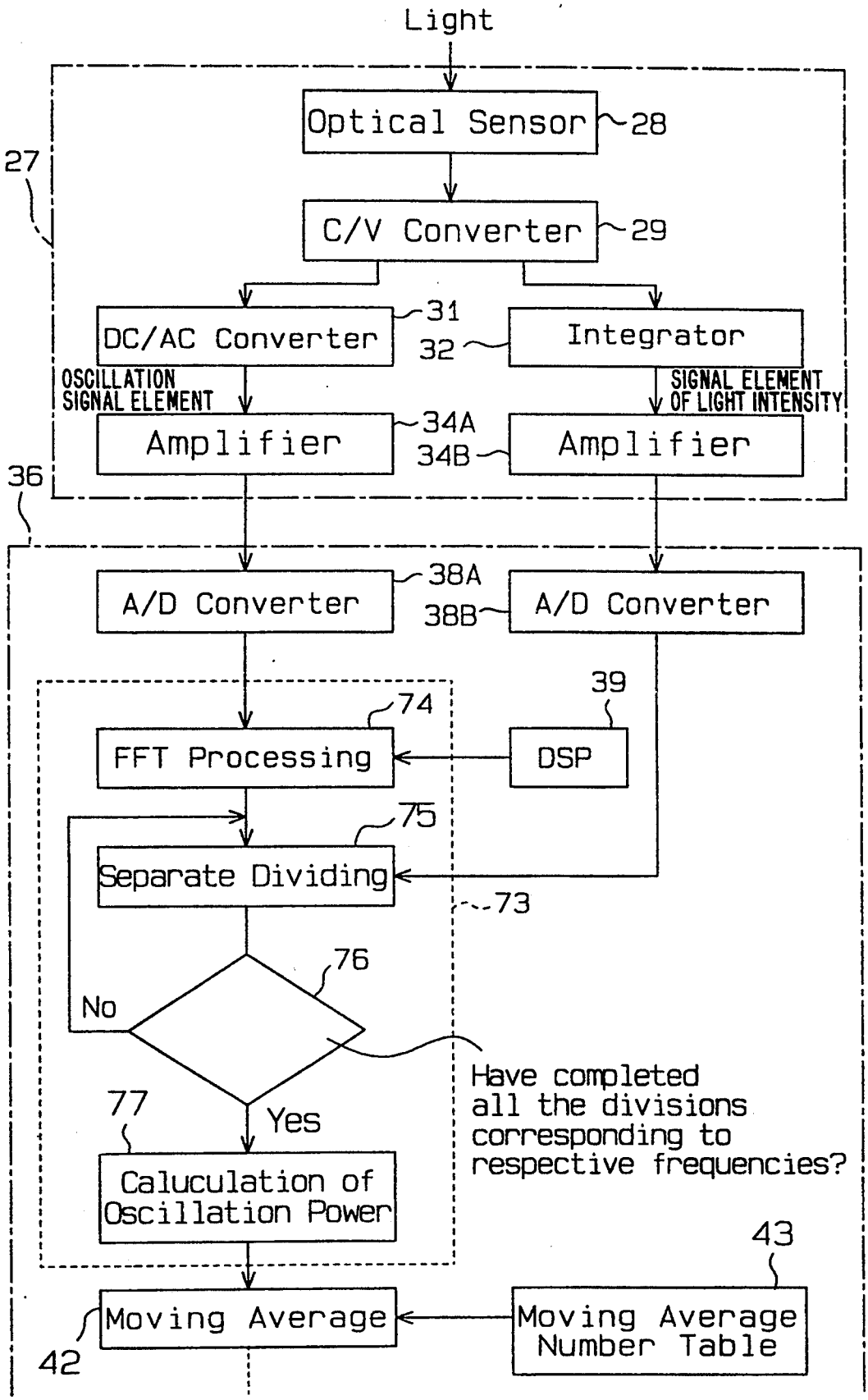
FIG. 22 illustrates a fourth embodiment of the present invention, and is a block diagram showing a sensor amplifier and a part of a combustion controller.

According to the first through third embodiments, after a signal compensation by the analog divider 33 in the sensor amplifier 27, the compensated signal is converted into the digital signal by means of the A/D converter 38 disposed in the combustion controller 36. The oscillation power is obtained through the frequency analysis of the digital signal by means of the FFT processing unit 41. On the other hand, the fourth embodiment provides another signal processing sequence as shown in FIG. 22. The fourth embodiment discloses that the signal compensation of the division may be executed after the A/D conversion of the analog signal and FFT processing operation. The fourth embodiment will now be described emphasizing the difference between it and the first embodiment.

As shown in FIG. 22, the sensor amplifier 27 according to the fourth embodiment includes two amplifiers 34A and 34B which are connected to the DC/AC converter 31 and integrator 32 respectively, instead of the analog divider in the first embodiment. The combustion controller 36 includes two A/D converters 38A and 38B which correspond to the amplifiers 34A and 34B, respectively. The controller 36 further includes a processing block 73 for FFT process and light intensity compensation, which is surrounded by a broken line, in place of the FFT processing unit 41 in the first embodiment. The processing block 73 includes a FFT processing unit 74, a separate dividing unit 75, a completion determining unit 76 for detecting the completion of separate dividing process and a calculation unit 77 for calculating a compensated oscillation power.

The first amplifier 34A amplifies the oscillation signal element transmitted from the DC/AC converter 31. The second amplifier 34B amplifies the signal element of light intensity transmitted from the integrator 32. In this case, the amplification factor (i.e., gain) of the first amplifier 34A should perfectly coincide with that of the second amplifier 34B.

The amplified oscillation signal element is converted into the digital signal by the first A/D converter 38A. The FFT processing unit 74, together with the DSP 39, calculates power spectra of the signals corresponding to respective frequencies for the frequency analysis, based on the digital signal. The separate dividing unit 75 divides the respective power spectra by the signal element of light intensity, which is digitized by the second A/D converter 38B.

The completion determining unit 76 determines whether or not the number of times of the processing by the separate dividing unit 75 coincides with the number (N) of resolution of the FFT processing. In other words, the separate dividing unit 75 repeatedly processes until all power spectra obtained through the FFT .processing have been processed through the divisional compensation process, respectively. Consequently, the compensated power spectra, which correspond to respective frequencies in the entire measuring frequency region for the frequency analysis are calculated.

For example, when the measuring frequency for the frequency analysis is in the range of zero to 200 Hz and the resolution the FFT processing is two hundred lines, two hundred of the compensated power spectra, which correspond to the respective frequencies parted by 1 Hz intervals, are calculated by the loop processing in the separate dividing unit 75 and completion determining unit 76.

The power calculation unit 77 calculates a compensated oscillation power by cumulating the entire value of the compensated power spectra. According to the above-described example, the total sum of two hundred compensated power spectra values becomes an oscillation power in which the influence originating in the intensity of light is compensated.

The oscillation power calculated through the sequences described in the fourth embodiment is equivalent to the oscillation power calculated through the sequences described in the first embodiment, and can be utilized as an indicator for the control of excess air ratio for a boiler. Although the signal compensation based on the signal element of light intensity from the integrator 32 is adopted in the fourth embodiment, the sequences according to the fourth embodiment can be combined with the signal compensation process according to the second embodiment.

Although only four embodiments of the present invention have been described herein, it should be apparent to those skilled in the art that the present invention may be embodied in many other specific forms without departing from the spirit or scope of the invention. Particularly, it should be understood that following modifications may be applied to the present invention.

According to the first embodiment, the flow of fuel is directly measured by means of the flow meter 24. Instead the meter 24, the flow of fuel can be indirectly detected through a signal transmitted from the pressure regulator 35 to the control motor 18.

A sensor, such as a silicon photo diode or photo transistor, may be employed in each embodiment, which can convert the radiated light originated from the combustion flame into a respective electric signal.

The combustion control method of the present invention including the first through fourth embodiments can be applied to any type of combustion apparatus, in which the oscillation power is obtained based on the detected signal by an optical sensor, and the angle of an air control valve is controlled such that the obtained oscillation power approaches to a predetermined power value. Such combustion apparatuses include a flue and smoke tube boiler and a water-tube boiler. The present invention can be applied to an air-conditioning equipment of a booth for coating and a washing equipment for a machinery, in addition to the boiler 1 and industrial furnace 61.

Therefore, the present examples and embodiments are to be considered as illustrative and not restrictive and the invention is not to be limited to the details giving herein, but may be modified within the scope of the appended claims.

What is claimed is:

1. A method for controlling combustion condition in a combustion facility, the combustion facility including a combustion apparatus having a burner, a fuel feeding pipe connected to the burner and having a fuel control valve for controlling the feeding of fuel, an air feeding pipe connected to the burner and having an air control valve for controlling the feeding of air; a detection device for detecting radiated light originating in a combustion flame of the burner, and a combustion controller for controlling an open position of the air control valve based on detection data from the detection device, the method comprising the steps of:

A) converting the radiated light detected by the detection device into a first electric signal, wherein said first electric signal includes an intensity signal element corresponding to the intensity of the detected light and an oscillation signal element corresponding to fluctuations of the combustion flame caused by the feeding of air to the burner;

B) extracting said oscillation signal element from said first electric signal;

C) extracting an intensity factor, representative of a real intensity of the radiated light originating in only the combustion flame, from said first electric signal;

D) generating a second electric signal by dividing said oscillation signal element by said intensity factor, so as to compensate said oscillation signal element which is influenced by the intensity of radiated light;

E) applying frequency analysis to said second electric signal;

F) calculating an oscillation power based on the result of the frequency analysis, wherein said oscillation power is related to the state of the combustion flame; and G) performing feedback-control of the open position of the air control valve, in such a manner that said calculated oscillation power approaches a predetermined optimum oscillation power.

2. The method according to claim 1, wherein said intensity factor is said intensity signal element given by integrating said first electric signal to make it smooth.

3. The method according to claim 2, wherein the combustion apparatus is a boiler having a water-cooled internal wall.

4. The method according to claim 1, wherein said intensity factor is obtained on the basis of said oscillation signal element.

5. A method for controlling combustion condition in a combustion facility, the combustion facility including a combustion apparatus having a burner, a fuel feeding pipe connected to the burner and having a fuel control valve for controlling the feed of fuel, an air feeding pipe connected to the burner and having an air control valve for controlling the feeding of air; a detection device for detecting radiated light originating in a combustion flame of the burner, and a combustion controller for controlling an open position of the air control valve based on detection data from the detection device, the method comprising the steps of:

A) converting the radiated light detected by the detection device into a first electric signal, wherein said first electric signal includes an intensity signal element corresponding to the intensity of the detection light and an oscillation signal element corresponding to fluctuations of the combustion flame caused by the feeding of air to the burner;

B) extracting said oscillation signal element from said first electric signal;

C) extracting from said first electric signal an intensity factor signal element on the basis of the oscillating signal element, the intensity factor signal element being representative of a real intensity of the radiated light originating in only the combustion flame, the step of extracting the intensity factor signal includes the substeps of rectifying the oscillation signal element, and integrating the rectified signal;

D) generating a second electric signal by dividing said oscillation signal element by said intensity factor, so as to compensate said oscillation signal element which is influenced by the intensity of radiated light;

E) applying frequency analysis to said second electric signal;

F) calculating an oscillation power based on the result of the frequency analysis, wherein said oscillation power is related to the state of the combustion flame; and G) performing feedback-control of the open position of the air control valve, in such a manner that said calculated oscillation power approaches a predetermined optimum oscillation power.

6. The method according to claim 4, wherein said intensity factor is the maximum amplitude of said oscillation signal element.

7. The method according to claim 4, wherein said intensity factor is a value obtained by squaring the amplitude of said oscillation signal element, at each predetermined time interval.

8. The method according to claim 4, wherein said intensity factor is a square root of the value obtained by squaring the amplitude of said oscillation signal element, at each predetermined time interval.

9. The method according to claim 4, wherein the combustion apparatus is an industrial furnace having an internal wall and/or an accommodated article in the industrial furnace which can generate radiation heat, when the internal temperature in said furnace becomes high.

10. The method according to claim 1 further comprising the step of eliminating a signal in a predetermined low frequency region from said second electric signal, by means of a high-pass filter.

11. The method according to claim 10, wherein said predetermined low frequency region is in a range of from zero Hertz to 20 Hz.

12. The method according to claim 1, wherein the detected light by the detection device is infrared.

13. The method according to claim 1, wherein said oscillation power is a value calculated by integrating power spectra in accordance with a result of said frequency analysis.

14. The method according to claim 1 for use in the control of an excess air ratio in the combustion apparatus.

15. A method for controlling combustion condition in a combustion facility, the combustion facility including a combustion apparatus having a burner, a fuel feeding pipe connected to the burner and having a fuel control valve for controlling the feeding of fuel, an air feeding pipe connected to the burner and having an air control valve for controlling the feeding of air; a detection device for detecting radiated light originating in a combustion flame of the burner; and a combustion controller for controlling an open position of the air control valve based on the detection data from the detection device, the method comprising the steps of:

A) converting the radiated light detected by the detection device into a first electric signal, wherein said first electric signal includes an intensity signal element corresponding to the intensity of the detected light and an oscillation signal element corresponding to fluctuations of the combustion flame caused by the feeding of air to the burner;

B) extracting said oscillation signal element from said first electric signal;

C) extracting an intensity factor, representative of a real intensity of the radiated light originating in only the combustion flame, from said first electric signal;

D) applying frequency analysis to said extracted oscillation signal element, thereby obtaining power spectrum values of the individual signals corresponding to respective frequencies in said frequency analysis;

E) dividing each of said power spectrum values by said intensity factor;

F) summing up all of said divided power spectrum values to calculate an oscillation power, wherein said oscillation power is related to the state of the combustion flame; and G) performing feedback-control of the open position of the air control valve, in such a manner that said calculated oscillation power approaches a predetermined optimum oscillation power.

16. The method according to claim 15, wherein said intensity factor is said intensity signal element given by integrating said first electric signal to make it smooth.

17. The method according to claim 15, wherein the combustion apparatus is a boiler having a water-cooled internal wall.

18. The method according to claim 15, wherein the light detected by the detection device is infrared.

19. The method according to claim 15 for use in the control of excess air ratio in the combustion apparatus.

* * * * *